US011769438B2

(12) United States Patent
Kotaki et al.

(10) Patent No.: US 11,769,438 B2
(45) Date of Patent: Sep. 26, 2023

(54) DISPLAY DRIVER AND DISPLAY APPARATUS

(71) Applicant: LAPIS Technology Co., Ltd., Yokohama (JP)

(72) Inventors: Takuro Kotaki, Yokohama (JP); Atsushi Hirama, Yokohama (JP); Hiroshi Tsuchi, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 0 days.

(21) Appl. No.: 17/583,998

(22) Filed: Jan. 25, 2022

(65) Prior Publication Data

US 2022/0246079 A1 Aug. 4, 2022

(30) Foreign Application Priority Data

Jan. 29, 2021 (JP) ..... 2021-012767

(51) Int. Cl.
*G09G 3/20* (2006.01)

(52) U.S. Cl.
CPC ... *G09G 3/2003* (2013.01); *G09G 2310/0291* (2013.01); *G09G 2310/0297* (2013.01);
(Continued)

(58) Field of Classification Search
CPC ... G09G 2300/0452; G09G 2300/0819; G09G 2300/0828; G09G 2300/0842;
(Continued)

(56) References Cited

U.S. PATENT DOCUMENTS

2021/0366343 A1* 11/2021 Oh ..... G09G 3/3291
2022/0068184 A1* 3/2022 Oh ..... G09G 3/3291
2022/0383803 A1* 12/2022 Jang ..... G09G 3/32

FOREIGN PATENT DOCUMENTS

JP 2004-301946 A 10/2004
JP 2005-148679 A 6/2005
JP 2007-334109 A 12/2007

* cited by examiner

*Primary Examiner* — Kenneth Bukowski
(74) *Attorney, Agent, or Firm* — Rabin & Berdo, P.C.

(57) ABSTRACT

The present invention includes first to j-th DA conversion circuits that are fixedly coupled to one of a plurality of gradation reference voltage generating circuits steadily generating respective gradation reference voltage groups according to gamma correction characteristics of color components different from one another, and select a gradation reference voltage corresponding to a pixel data piece among the gradation reference voltage group generated by the one of gradation reference voltage generating circuits to output the gradation reference voltage as a gradation voltage, an output unit that assigns the first to j-th gradation voltages to respective first to j-th driving voltage signals in a mode according to an output switching signal, and outputs the first to j-th driving voltage signals to the display panel, and an output control unit that generates the output switching signal to switch modes of assigning the first to j-th gradation voltages to the first to j-th driving voltage signals at every division period obtained by dividing a horizontal scanning period by a division number indicated by a division number setting signal, and outputs an input switching signal that causes the first to j-th driving voltage signals to be input in turn to the respective data lines as many as the division number at a cycle of the division periods for the respective first to j-th driving voltage signals.

10 Claims, 20 Drawing Sheets

[PenTile MATRIX, TIME-DIVISIONALLY DRIVEN (DIVISION NUMBER 2)]

| CONTROL ITEMS | | N-th HORIZONTAL SCANNING PERIOD | | (N+1)-th HORIZONTAL SCANNING PERIOD | |
|---|---|---|---|---|---|
| | | FIRST | SECOND | FIRST | SECOND |
| Sa, Sb CONTROLS | P1 (G1) | E1 (R) | E2 (G) | E3 (B) | E2 (G) |
| | P2 (G2) | E3 (B) | E4 (G) | E1 (R) | E4 (G) |
| | P3 (G3) | E2 (G) | E1 (R) | E2 (G) | E3 (B) |
| | P4 (G4) | E4 (G) | E3 (B) | E4 (G) | E1 (R) |
| SA CONTROL | SW1A ~SW4A | ON | OFF | ON | OFF |
| SB CONTROL | SW1B ~SW4B | OFF | ON | OFF | ON |

(52) U.S. Cl.
CPC ..... *G09G 2320/0666* (2013.01); *G09G 2320/0673* (2013.01)

(58) Field of Classification Search
CPC ... G09G 2300/0861; G09G 2310/0262; G09G 2310/0291; G09G 2310/0297; G09G 2320/045; G09G 2320/0673; G09G 3/2003; G09G 3/3291
See application file for complete search history.

[PenTile MATRIX, TIME-DIVISIONALLY DRIVEN (DIVISION NUMBER 2)]

[PenTile MATRIX, TIME-DIVISIONALLY DRIVEN (DIVISION NUMBER 2)]

| CONTROL ITEMS | | N-th HORIZONTAL SCANNING PERIOD | | (N+1)-th HORIZONTAL SCANNING PERIOD | |
|---|---|---|---|---|---|
| | | FIRST | SECOND | FIRST | SECOND |
| Sa, Sb CONTROLS | P1 (G1) | E1 (R) | E2 (G) | E3 (B) | E2 (G) |
| | P2 (G2) | E3 (B) | E4 (G) | E1 (R) | E4 (G) |
| | P3 (G3) | E2 (G) | E1 (R) | E2 (G) | E3 (B) |
| | P4 (G4) | E4 (G) | E3 (B) | E4 (G) | E1 (R) |
| SA CONTROL | SW1A ~SW4A | ON | OFF | ON | OFF |
| SB CONTROL | SW1B ~SW4B | OFF | ON | OFF | ON |

FIG. 5

[PenTile MATRIX, NORMALLY DRIVEN]

| CONTROL ITEMS | | N-th HORIZONTAL SCANNING PERIOD | (N+1)-th HORIZONTAL SCANNING PERIOD |
|---|---|---|---|
| Sa, Sb CONTROLS | P1 (G1) | E1 (R) | E3 (B) |
| | P2 (G2) | E2 (G) | E2 (G) |
| | P3 (G3) | E3 (B) | E1 (R) |
| | P4 (G4) | E4 (G) | E4 (G) |

FIG. 8

[RGB STRIPE ARRANGEMENT, TIME-DIVISIONALLY DRIVEN (DIVISION NUMBER 2)]

| CONTROL ITEMS | | N-th HORIZONTAL SCANNING PERIOD | | (N+1)-th HORIZONTAL SCANNING PERIOD | |
|---|---|---|---|---|---|
| | | FIRST | SECOND | FIRST | SECOND |
| Sa, Sb CONTROLS | P1(G1) | E1(R) | E2(G) | E1(R) | E2(G) |
| | P2(G2) | E3(B) | E1(R) | E3(B) | E1(R) |
| | P3(G3) | E2(G) | E3(B) | E2(G) | E3(B) |
| SA CONTROL | SW1A ~SW3A | ON | OFF | ON | OFF |
| SB CONTROL | SW1B ~SW3B | OFF | ON | OFF | ON |

FIG. 11

[RGB STRIPE ARRANGEMENT, NORMALLY DRIVEN]

| CONTROL ITEMS | | N-th HORIZONTAL SCANNING PERIOD | (N+1)-th HORIZONTAL SCANNING PERIOD |
|---|---|---|---|
| Sa, Sb CONTROLS | P1(G1) | E1(R) | E1(R) |
| | P2(G2) | E2(G) | E2(G) |
| | P3(G3) | E3(B) | E3(B) |

FIG. 14

[PenTile MATRIX, TIME-DIVISIONALLY DRIVEN (DIVISION NUMBER 4)]

| CONTROL ITEMS | | | N-th HORIZONTAL SCANNING PERIOD | | | | (N+1)-th HORIZONTAL SCANNING PERIOD | | | |
|---|---|---|---|---|---|---|---|---|---|---|
| | | | FIRST | SECOND | THIRD | FOURTH | FIRST | SECOND | THIRD | FOURTH |
| Sa, Sb, Sc, Sd CONTROLS | P1 (G1) | | E1 (R) | E2 (G) | E3 (B) | E4 (G) | E3 (B) | E2 (G) | E1 (R) | E4 (G) |
| | P2 (G2) | | E2 (G) | E3 (B) | E4 (G) | E1 (R) | E2 (G) | E1 (R) | E4 (G) | E3 (B) |
| | P3 (G3) | | E3 (B) | E4 (G) | E1 (R) | E2 (G) | E1 (R) | E4 (G) | E3 (B) | E2 (G) |
| | P4 (G4) | | E4 (G) | E1 (R) | E2 (G) | E3 (B) | E4 (G) | E3 (B) | E2 (G) | E1 (R) |
| SA TO SD CONTROLS | WS1 ~WS4 | A | ON | OFF | | | ON | OFF | | |
| | | B | OFF | ON | OFF | | OFF | ON | OFF | |
| | | C | OFF | | ON | OFF | OFF | | ON | OFF |
| | | D | OFF | | | ON | OFF | | | ON |

FIG. 18

[RGB STRIPE ARRANGEMENT, TIME-DIVISIONALLY DRIVEN (DIVISION NUMBER 3)]

| CONTROL ITEMS | | | N-th HORIZONTAL SCANNING PERIOD | | | (N+1)-th HORIZONTAL SCANNING PERIOD | | |
|---|---|---|---|---|---|---|---|---|
| | | | FIRST | SECOND | THIRD | FIRST | SECOND | THIRD |
| Sa, Sb, Sc CONTROLS | P1 (G1) | | E1 (R) | E2 (G) | E3 (B) | E1 (R) | E2 (G) | E3 (B) |
| | P2 (G2) | | E2 (G) | E1 (R) | E1 (R) | E2 (G) | E1 (R) | E1 (R) |
| | P3 (G3) | | E3 (B) | E3 (B) | E2 (G) | E3 (B) | E3 (B) | E2 (G) |
| SA, SB, SC CONTROLS | WS1a ~WS3a | A | ON | OFF | | ON | OFF | |
| | | B | OFF | ON | OFF | OFF | ON | OFF |
| | | C | OFF | | ON | OFF | | ON |

FIG. 20

DISPLAY DRIVER AND DISPLAY APPARATUS

CROSS-REFERENCE TO RELATED APPLICATION

This application is based upon and claims the benefit of priority from the prior Japanese Patent Application No. 2021-12767 filed on Jan. 29, 2021, the entire contents of which are incorporated herein by reference.

BACKGROUND

1. Technical Field

The present invention relates to a display driver that drives a display panel corresponding to a video signal and a display apparatus.

2. Description of the Related Art

As a liquid crystal or an organic EL display apparatus, there has been known one that includes a display panel in which display cells are formed in respective intersecting portions between a plurality of scanning lines and a plurality of signal lines (hereinafter referred to as data lines) and a display driver that drives the plurality of data lines of this display panel.

The display driver includes a DA conversion unit that converts a pixel data piece representing a luminance level of each pixel based on a video signal to a gradation voltage having a voltage value corresponding to the luminance level and a plurality of output amplifiers that supply driving voltages obtained by respectively amplifying the plurality of gradation voltages to the plurality of data lines in the display device (for example, see JP-A-2004-301946).

Now, in recent years, the image resolution has been increased also in a liquid crystal or an organic electroluminescence (EL) display apparatus mounted on a portable information terminal, such as a smart phone. In association with this, the data lines of the display panel have been increased. Accordingly, the above-described DA conversion units and output amplifiers are required as many as the number of the data lines, and therefore, there has been a problem of a size increase in a display driver. Therefore, there has been proposed a liquid crystal display apparatus in which a demultiplexer that drives a plurality of data lines one by one in a time divisional manner (referred to as time-divisionally driving) by one output amplifier is provided on a display panel (for example, see JP-A-2007-334109).

As an organic EL type display panel, there also is one that employs what is called PenTile matrix that configures one pixel (color pixel) with four display cells of red, green, blue, and green adjacent in two rows and two columns, besides a stripe arrangement that configures one pixel (color pixel) by arranging three display cells of red, green, and blue, or four display cells of red, green, blue, and white aligned on each scanning line. In a display panel that employs the stripe arrangement, the arrangement configuration of three or four display cells that correspond to kinds of colors that configure one pixel is the same by each scanning line. On the other hand, in a display panel that employs the PenTile matrix, the arrangement configuration of four display cells that configure one pixel is changed by each scanning line. For example, on even numbered scanning lines, each pixel is configured of four display cells arranged in the order of red, green, blue, and green, and on odd numbered scanning lines, each pixel is configured of four display cells arranged in the order of blue, green, red, and green. Note that, both in the stripe arrangement and the PenTile matrix, as the display cells arranged on the same scanning line, display cells that correspond to color components that configure a pixel are adjacently arranged.

Here, in converting a pixel data piece to a gradation voltage, the above-described DA conversion unit receives a plurality of reference gradation voltages having voltage values according to gamma characteristics of the respective colors (red, green, blue, (white)), selects one that corresponds to a luminance level represented by the pixel data piece among the plurality of reference gradation voltages, and outputs this as the gradation voltage.

Accordingly, for example, when each data line is time-divisionally driven in every two adjacent data lines in one horizontal scanning period, first, a plurality of reference gradation voltages according to gamma characteristics of a first color (for example, red or blue) are supplied to each of DA conversion circuits the number of which is half the number of the data lines, and subsequently, a plurality of reference gradation voltages according to gamma characteristics of a second color (for example, green) are supplied to each of DA conversion circuits the number of which is half the number of the data lines.

Therefore, there is proposed a technique that provides a switch that switches reference gradation voltage groups according to such gamma characteristics of respective colors in a display driver (for example, see FIG. 15 in JP-A-2005-148679).

SUMMARY

As described above, when the display panel employing the stripe arrangement and the PenTile matrix is driven in time-divisionally driving, the reference gradation voltage group to be supplied to the DA conversion circuit needs to be switched from one that complies with the gamma characteristics of the first color to one that complies with the gamma characteristics of the second color with different color component in one horizontal scanning period.

Accordingly, it takes time from the time point of such switching of the gamma characteristics until the respective voltage values of the plurality of reference gradation voltages actually received by the DA conversion circuit stabilize in desired values. Therefore, there has been a problem of causing a reduced driving speed.

Also, in deploying many varieties of display panels with different resolutions, manufacturing a dedicated display driver for each display panel of a time-divisionally driven type or of a normally driven type has caused a problem of a lengthened development period and a high manufacturing cost.

Therefore, an objective of the present invention is to provide a display driver that ensures high-speed driving of various kinds of display panels and a display apparatus including the display driver with a reduced manufacturing cost.

A display driver according to the present invention drives a display panel in which a plurality of display cells constituting cell groups each including j (j is an integer of two or more) display cells are arranged side by side on each of a plurality of horizontal scanning lines. The plurality of horizontal scanning lines are arranged side by side and intersects with a plurality of data lines. The display driver drives the display panel according to pixel data pieces corresponding to the plurality of respective display cells. The display driver includes a plurality of gradation reference voltage generating circuits, first to j-th DA conversion circuits, an output unit, and an output control unit. The plurality of gradation reference voltage generating circuits steadily generate respective gradation reference voltage groups according to gamma correction characteristics of color components different from one another. The first to j-th DA conversion circuits select a gradation reference voltage corresponding to a luminance level represented by the pixel data piece among the gradation reference voltage group to output the gradation reference voltage as a gradation voltage. The first to j-th DA conversion circuits are disposed corresponding to the cell groups. The first to j-th DA conversion circuits are configured by including the respective different color components. The first to j-th DA conversion circuits are each fixedly coupled to one of the plurality of gradation reference voltage generating circuits, the gradation reference voltage group being generated by the one of the gradation reference voltage generating circuits. The output unit receives the first to j-th gradation voltages together with an output switching signal, the output unit assigning the first to j-th gradation voltages to respective first to j-th driving voltage signals in a mode according to the output switching signal. The output unit outputs the assigned first to j-th driving voltage signals to the display panel. The output control unit receives a division number setting signal indicating a division number to generate a signal to switch modes of assigning the first to j-th gradation voltages to the first to j-th driving voltage signals at every division period obtained by dividing a horizontal scanning period by the division number as the output switching signal. The output control unit generates and outputs an input switching signal that causes the first to j-th driving voltage signals to be input in turn to the respective data lines as many as the division number at a cycle of the division periods for the respective first to j-th driving voltage signals.

A display apparatus according to the present invention includes a display panel and a display driver. In the display panel, a plurality of display cells constituting cell groups each including j (j is an integer of two or more) display cells are arranged side by side on each of a plurality of horizontal scanning lines. The plurality of horizontal scanning lines are arranged side by side and intersects with a plurality of data lines. The display driver drives the display panel according to pixel data pieces corresponding to the plurality of respective display cells. The display driver includes a plurality of gradation reference voltage generating circuits, first to j-th DA conversion circuits, an output unit, and an output control unit. The plurality of gradation reference voltage generating circuits steadily generate respective gradation reference voltage groups according to gamma correction characteristics of color components different from one another. The first to j-th DA conversion circuits that select a gradation reference voltage corresponding to a luminance level represented by the pixel data piece among the gradation reference voltage group to output the gradation reference voltage as a gradation voltage. The first to j-th DA conversion circuits are disposed corresponding to the cell groups. The first to j-th DA conversion circuits are configured by including the respective different color components. The first to j-th DA conversion circuits are each fixedly coupled to one of the plurality of gradation reference voltage generating circuits. The gradation reference voltage group is generated by the one of the gradation reference voltage generating circuits. The output unit receives the first to j-th gradation voltages together with an output switching signal, the output unit assigning the first to j-th gradation voltages to respective first to j-th driving voltage signals in a mode according to the output switching signal. The output unit outputs the assigned first to j-th driving voltage signals to the display panel. The output control unit receives a division number setting signal indicating a division number to generate a signal to switch modes of assigning the first to j-th gradation voltages to the first to j-th driving voltage signals at every division period obtained by dividing a horizontal scanning period by the division number as the output switching signal. The output control unit generates an input switching signal that causes the first to j-th driving voltage signals to be input in turn to the respective data lines as many as the division number at a cycle of the division periods for the respective first to j-th driving voltage signals. The output control unit outputs the input switching signal to the display panel.

With the display driver according to the present invention, even though any of the display panels of a time-divisionally driven type, a normally driven type, or the like is a driving object, when a DA conversion that converts a pixel data piece to an analog gradation voltage using a reference gradation voltage group is performed, the switching of the gamma characteristics for the reference gradation voltage group is not necessary. This ensures high-speed driving the display panel because a delay in association with a switching process of the gamma characteristics is not generated.

Furthermore, the display driver according to the present invention can drive display panels of various kinds, such as time-divisionally driven type or normally driven type, and thus, the manufacturing cost can be reduced.

Accordingly, with the present invention, various kinds of display panels can be high-speed driven with a reduced manufacturing cost.

BRIEF DESCRIPTION OF THE DRAWINGS

FIG. 5 is a drawing illustrating a control configuration of a multiplexer circuit MUX and a demultiplexer circuit DMX (SW1A to SW4A and SW1B to SW4B) by an output control unit 124 when the display panel 20*a* is a driving object;

FIG. 8 is a drawing illustrating a control configuration of the multiplexer circuit MUX by the output control unit 124 when the display panel 20*b* is a driving object;

FIG. 11 is a drawing illustrating a control configuration of the multiplexer circuit MUX and a demultiplexer circuit DMXa (SW1A to SW3A and SW1B to SW3B) by the output control unit 124 when the display panel 20*c* is a driving object;

FIG. 14 is a drawing illustrating a control configuration of the multiplexer circuit MUX by the output control unit 124 when the display panel 20*d* is a driving object;

FIG. 18 is a drawing illustrating a control configuration of the multiplexer circuit MUX and a demultiplexer circuit DMXb (WS1 to WS4) by the output control unit 124 when the display panel 20*e* is a driving object;

FIG. 20 is a drawing illustrating a control configuration of the multiplexer circuit MUX and a demultiplexer circuit DMXc (WS1*a* to WS3*a*) by the output control unit 124 when the display panel 20*f* is a driving object.

DETAILED DESCRIPTION OF EMBODIMENTS

Embodiments of the present invention will be described in detail with reference to the drawings below.

Figure 1:
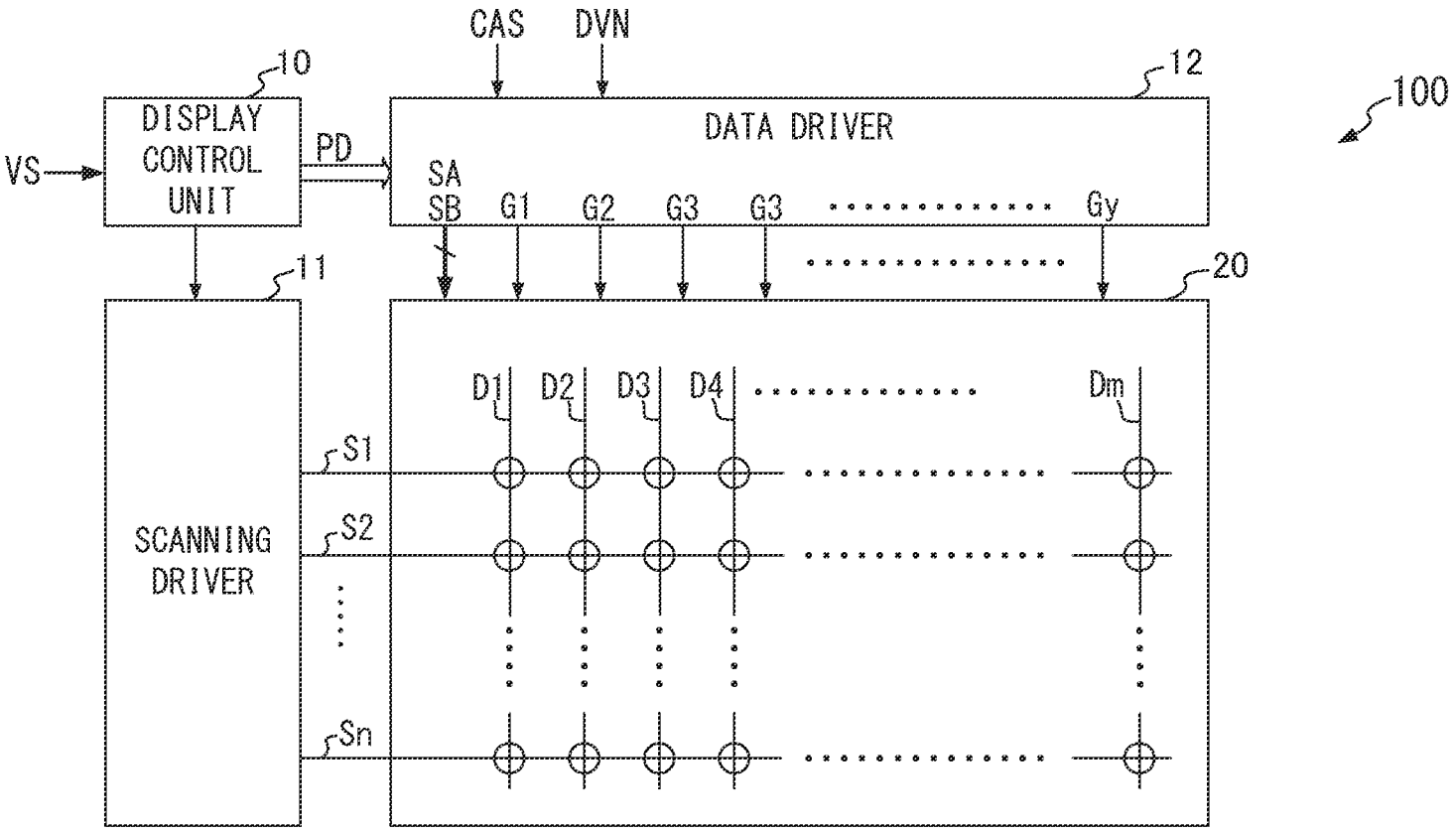
FIG. 1 is a block diagram illustrating a configuration of a display apparatus 100 including a display driver according to the present invention.

FIG. 1 is a block diagram illustrating a configuration of a display apparatus 100 including a display driver according to the present invention. As illustrated in FIG. 1, the display apparatus 100 includes a display control unit 10, a scanning driver 11, a data driver 12, and a display panel 20.

The display panel 20 is a PenTile system organic EL display panel or a stripe arrangement liquid crystal display panel. Note that the display panel 20 may be any one of a normally driven type or a time-divisionally driven type.

The display panel 20 includes n (n is an integer of two or more) horizontal scanning lines S1 to Sn that extend in a horizontal direction of a two-dimensional screen and m (m is an integer of two or more) data lines D1 to Dm that extend in a perpendicular direction of the two-dimensional screen. In regions of intersecting portions between the horizontal scanning lines and the data lines (regions encircled by circles), display cells for each color component necessary for color display, such as a red display cell functioning for displaying a red color, a green display cell functioning for displaying a green color, or a blue display cell functioning for displaying a blue color, are formed. A description is given below with an example where the color display is made by combining the display cells having three color components of red, green, and blue.

The display control unit 10 receives a video signal VS representing a luminance level of each pixel by each of color components of a red color, a green color, and a blue color as well as including a horizontal synchronization signal. The display control unit 10 generates a scanning signal according to the horizontal synchronization signal included in the video signal VS and supplies this to the scanning driver 11. Furthermore, the display control unit 10 supplies the data driver 12 with a video data signal PD including series of pixel data pieces representing the luminance levels in, for example, 8 bits for each of the red color, the green color, and the blue color based on the video signal VS.

The scanning driver 11 generates a scanning pulse according to the scanning signal supplied from the display control unit 10 and sequentially and alternatively applies this to the horizontal scanning lines S1 to Sn formed on the display panel 20. The data driver 12 is formed in a single or a plurality of semiconductor ICs.

The data driver 12 receives a cell arrangement signal CAS and a division number setting signal DVN together with the above-described video data signal PD. Note that the cell arrangement signal CAS is a signal that indicates which cell arrangement between an RGB stripe arrangement and PenTile matrix is employed by the display panel 20 as a driving object. The division number setting signal DVN indicates a division number "1" when the display panel 20 is of the normally driven type, whereas the division number setting signal DVN indicates a division number "2" or more when the display panel 20 is of a time-divisionally driven type.

The data driver 12 converts series of pixel data pieces included in the video data signal PD to driving voltage signals G1 to Gy in accordance with the cell arrangement signal CAS and the division number setting signal DVN, and outputs the driving voltage signals G1 to Gy to the display panel 20.

Figure 2:
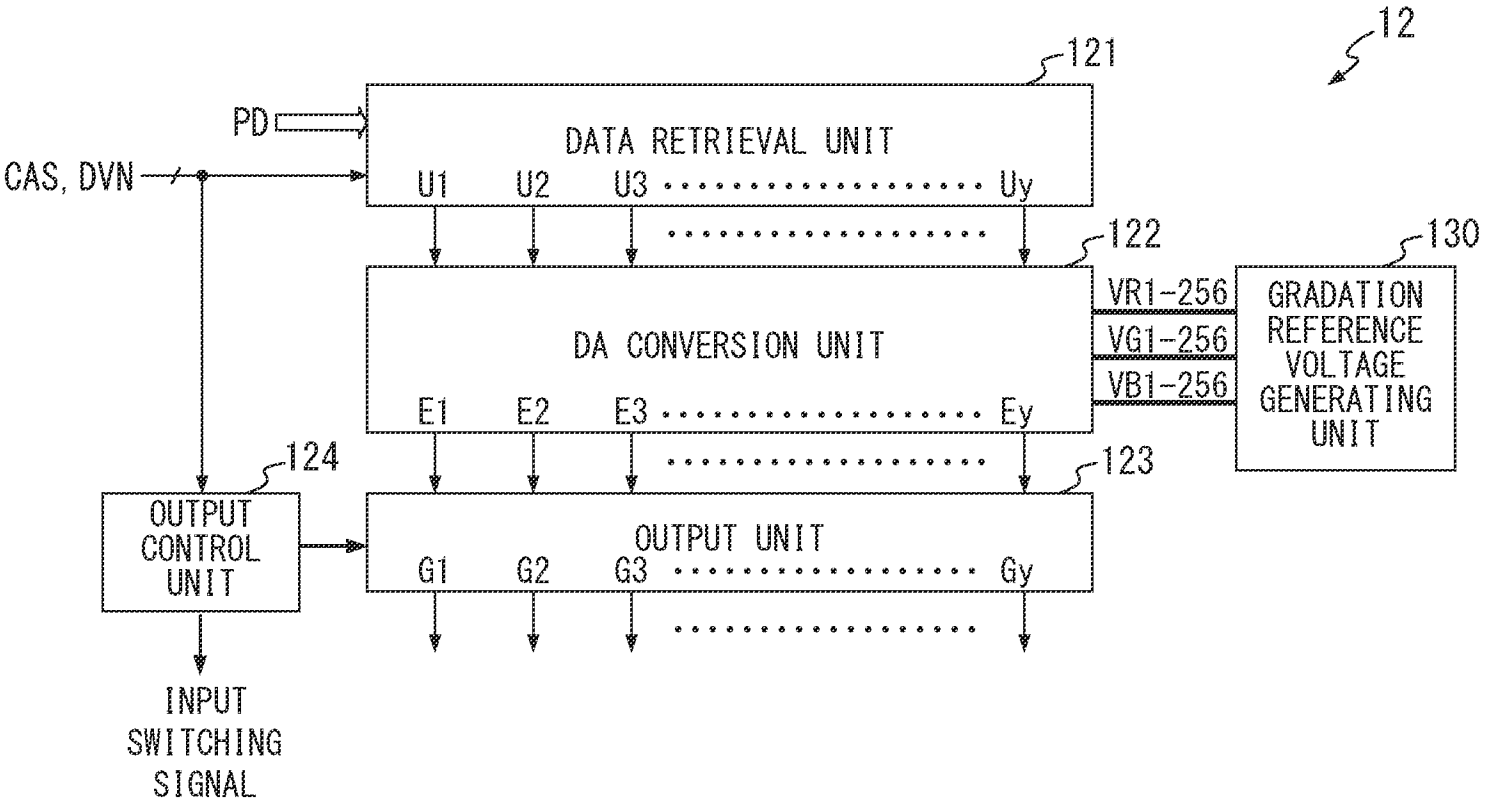
FIG. 2 is a block diagram illustrating an internal configuration of a data driver 12.

FIG. 2 is a block diagram illustrating an internal configuration of the data driver 12.

As illustrated in FIG. 2, the data driver 12 includes a data retrieval unit 121, a DA conversion unit 122, an output unit 123, an output control unit 124, and a gradation reference voltage generating unit 130.

The data retrieval unit 121 retrieves the series of the pixel data pieces included in the video data signal PD. When the division number setting signal DVN indicates the division number "1," the data retrieval unit 121 supplies y (y is an integer of two or more) pixel data pieces, which have been retrieved, each at every one horizontal scanning period to the DA conversion unit 122 as pixel data U1 to Uy. When the division number setting signal DVN indicates the division number "2" or more, the data retrieval unit 121 supplies y pixel data pieces, which have been retrieved as described above, each at each of division periods obtained by dividing one horizontal scanning period by the division number to the DA conversion unit 122 as the pixel data U1 to Uy.

The gradation reference voltage generating unit 130 generates gradation reference voltages VR1 to VR256 for 256 gradations according to a gamma correction characteristic of a red color component, gradation reference voltages VG1 to VG256 for 256 gradations according to a gamma correction characteristic of a green color component, and gradation reference voltages VB1 to VB256 for 256 gradations according to a gamma correction characteristic of a blue color component for respective color components forming the color display. The gradation reference voltage generating unit 130 supplies three systems of gradation reference voltage groups made of the generated gradation reference voltages VR1 to VR256, VG1 to VG256, and VB1 to VB256 to the DA conversion unit 122.

The DA conversion unit 122 includes first to y-th DA conversion circuits corresponding to the respective pixel data U1 to Uy. Each of the first to y-th DA conversion circuits receives one system of gradation reference voltage group among the above-described three systems of gradation reference voltage groups (VR1 to VR256, VG1 to VG256, and VB1 to VB256). Also, the first to y-th DA conversion circuits include groups of the DA conversion circuits corresponding to the cell arrangement. Specifically, in the stripe arrangement, the group includes at least three DA conversion circuits respectively corresponding to cells in the red color, the green color, and the blue color on the same horizontal scanning line and is configured of an integer multiple of the DA conversion circuits. In the PenTile matrix, the group includes at least four DA conversion circuits corresponding to cells in the red color, the green color, the blue color, and the green color on the same horizontal scanning line and is configured of an integer multiple of the DA conversion circuits. Each of the first to y-th DA conversion circuits selects a gradation reference voltage corresponding to a luminance level represented by the pixel data U, which has been received by the DA conversion circuit itself, among the 256 gradation reference voltages included in the gradation reference voltage group of the color component corresponding to the DA conversion circuit itself. The first to y-th DA conversion circuits supply the respective selected gradation reference voltages to the output unit 123 as gradation voltages E1 to Ey.

The output control unit 124 generates an input switching signal to perform input switching on data line group of the display panel 20 as a supply target of the driving voltage signals G1 to Gy based on the cell arrangement signal CAS and the division number setting signal DVN, and outputs this to the display panel 20. Furthermore, the output control unit 124 generates an output switching signal to control an operation of the output unit 123 based on the cell arrangement signal CAS and the division number setting signal DVN, and supplies the output switching signal to the output unit 123.

The output unit 123 assigns the gradation voltages E1 to Ey supplied from the DA conversion unit 122 to the respective driving voltage signals G1 to Gy, and outputs them. The output unit 123 changes the way of assigning according to the output switching signal upon assigning the gradation voltage E1 to Ey to the driving voltage signals G1 to Gy. Note that the data retrieval unit 121, the DA conversion unit 122, and the output unit 123 operate at a cycle of division periods obtained by dividing one horizontal scanning period by the division number specified by the division number setting signal DVN, and thus, the more the division number is, the higher speed they drive. In view of this, the gradation reference voltage generating unit 130 is configured to steadily generate the gradation reference voltages so as to stably supply the gradation reference voltages even in high-speed driving.

The following describes a driving operation of the display panel by the above-described data driver 12 in detail.

First, a description will be given with one example of an operation of the data driver 12 when the display panel that has the PenTile matrix and is of the time-divisionally driven type is driven.

[PenTile Matrix, Time-Divisionally Driven (Division Number "2")]

Figure 3:
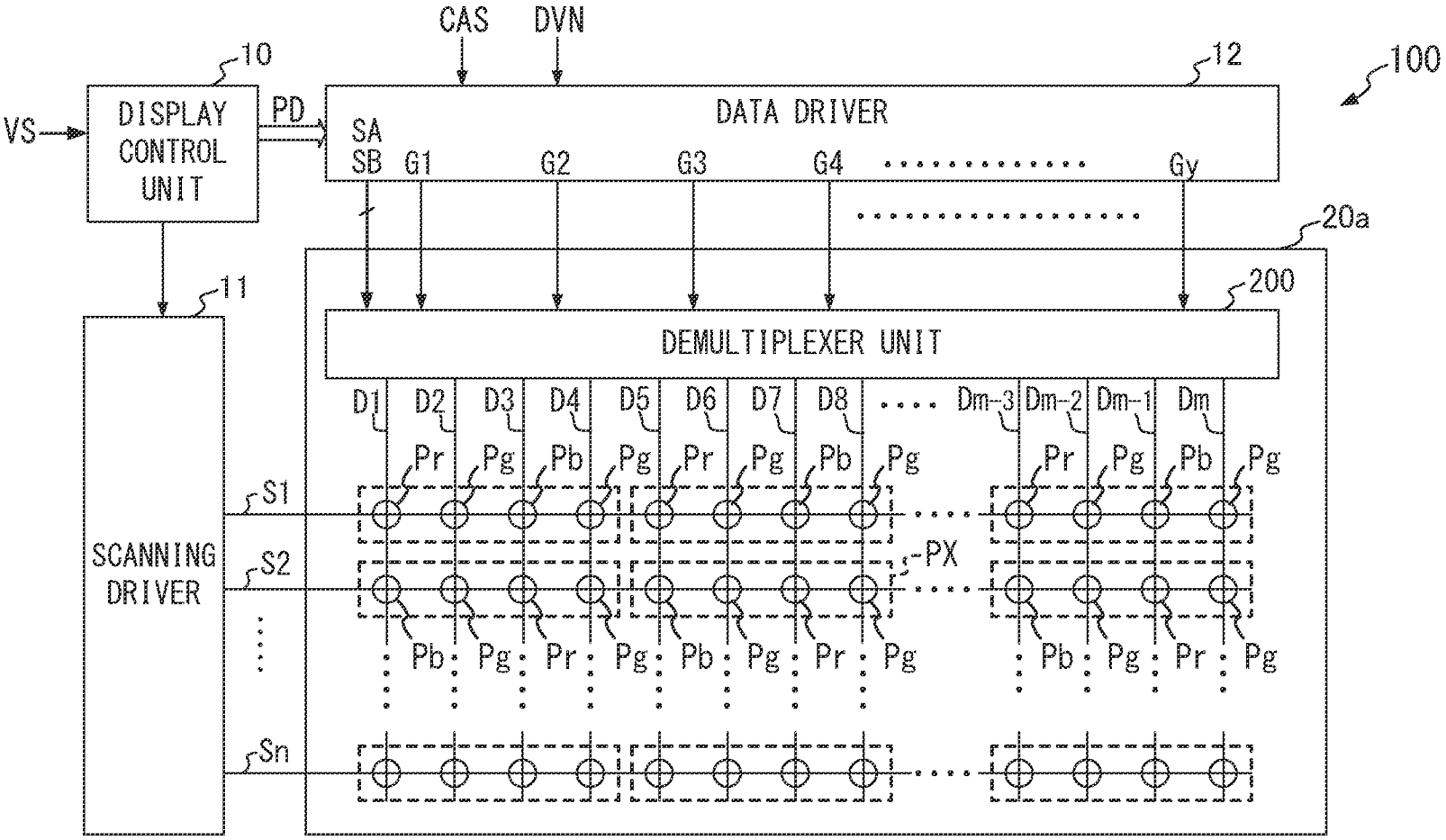
FIG. 3 is a block diagram illustrating a configuration of the display apparatus 100 including a display panel 20*a* that has a PenTile matrix and is of a time-divisionally driven type.

FIG. 3 is a block diagram illustrating a configuration of the display apparatus 100 including a display panel 20*a* that has the PenTile matrix and is of the time-divisionally driven type with the division number "2." Note that the respective operations of the display control unit 10 and the scanning driver 11 illustrated in FIG. 3 are the same as those illustrated in FIG. 1, thus omitting the description of the operations.

As illustrated in FIG. 3, the display panel 20*a* includes a demultiplexer unit 200, the n (n is an integer of two or more) horizontal scanning lines S1 to Sn that extend in the horizontal direction in the two-dimensional screen and the m data lines D1 to Dm that extend in the perpendicular direction of the two-dimensional screen. In the regions of the intersecting portions between the horizontal scanning lines and the data lines, a red display cell Pr functioning for displaying the red color, a green display cell Pg functioning for displaying the green color, or a blue display cell Pb functioning for displaying the blue color are formed. In the display panel 20*a*, four display cells adjacent to one another on each of the horizontal scanning lines S1 to Sn form one cell group PX (regions surrounded by dashed lines) corresponding to the driving. Note that the arrangement configuration of the four display cells in each cell group PX is, as illustrated in FIG. 3, an arrangement in which the red display cell Pr, the green display cell Pg, the blue display cell Pb, and the green display cell Pg are arranged side by side in this order on odd numbered horizontal scanning lines among the horizontal scanning lines S1 to Sn. On even numbered horizontal scanning lines, the arrangement configuration is an arrangement in which the blue display cell Pb, the green display cell Pg, the red display cell Pr, and the green display cell Pg are arranged side by side in this order. In the PenTile matrix, one color pixel is configured by a cell group of Pr, Pg, Pb, and Pg in two rows and two columns unlike the above-described cell group PX. For example, one color pixel is configured by four display cells adjacent to one another on each of the horizontal scanning lines S1 and S2 and the data lines D1 and D2.

The demultiplexer unit 200 receives the driving voltage signals G1 to Gy and input switching signals SA and SB output from the data driver 12. The demultiplexer unit 200 supplies the driving voltage signals G1 to Gy output from the data driver 12 to y data lines among the data lines D1 to Dm in accordance with the input switching signals SA and SB.

Figure 4:
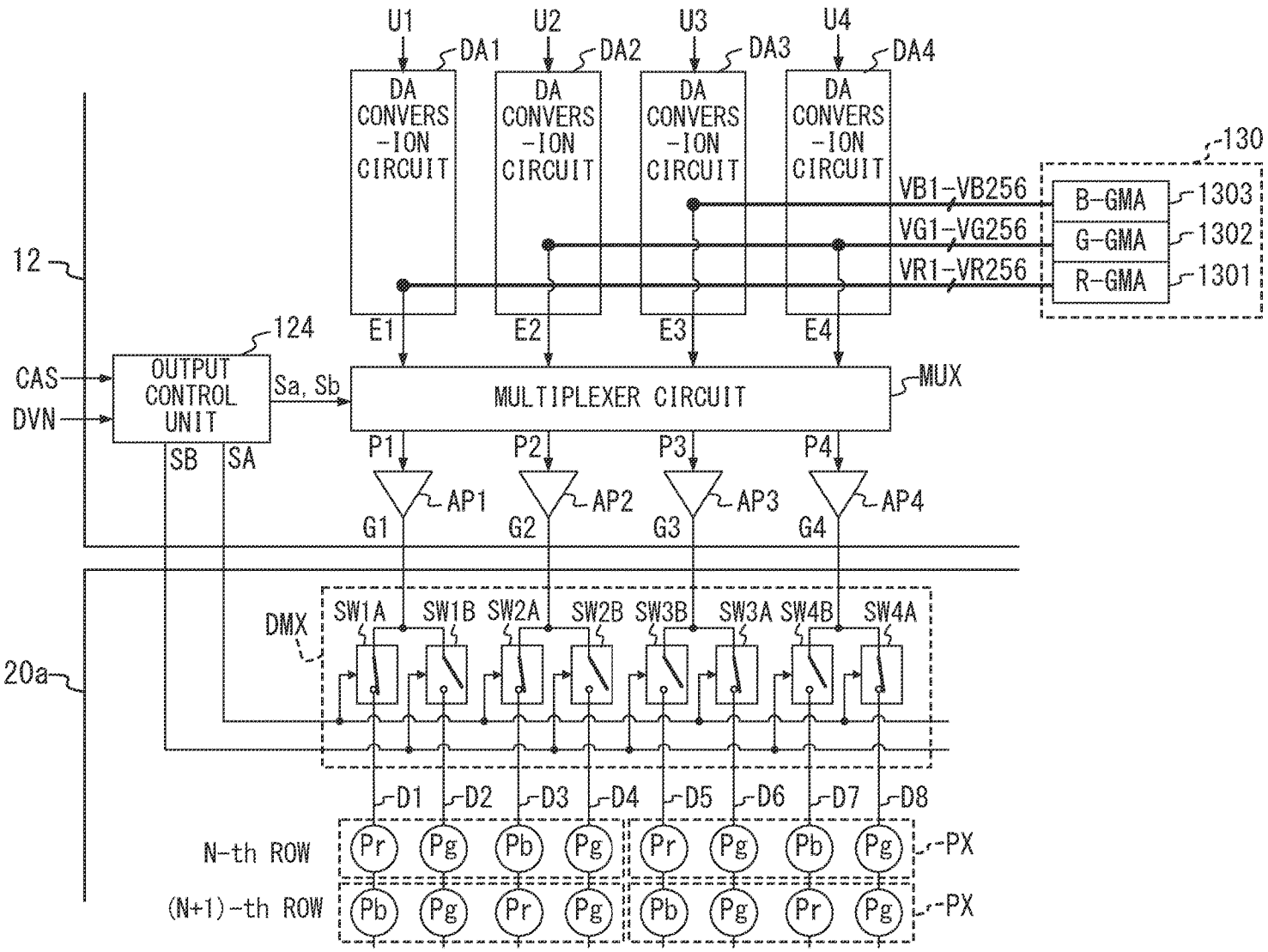
FIG. 4 is a block diagram excerpting and illustrating circuit blocks involved in driving voltage signals G1 to G4 from each of the data driver 12 and the display panel 20*a;*

FIG. 4 is a block diagram excerpting and illustrating circuit blocks involved in the driving voltage signals G1 to G4 from the data driver 12 and the display panel 20*a*.

The gradation reference voltage generating unit 130 includes a red gamma gradation reference voltage generating circuit (hereinafter referred to as an R-GMA) 1301, a green gamma gradation reference voltage generating circuit (hereinafter referred to as a G-GMA) 1302, and a blue gamma gradation reference voltage generating circuit (hereinafter referred to as a B-GMA) 1303. The R-GMA 1301 generates the gradation reference voltages VR1 to VR256 for 256 gradations according to the gamma correction characteristic of the red color component. The G-GMA 1302 generates the gradation reference voltages VG1 to VG256 for 256 gradations according to the gamma correction characteristic of the green color component. The B-GMA 1303 generates the gradation reference voltages VB1 to VB256 for 256 gradations according to the gamma correction characteristic of the blue color component.

The DA conversion unit 122 includes four DA conversion circuits DA1 to DA4 in a minimum group configuration in the PenTile matrix as illustrated in FIG. 4. In FIG. 4, for the convenience of the drawing, the DA conversion unit 122 and the output unit 123 are illustrated in a minimum group configuration, but the actual configuration is a configuration in which the minimum group configurations illustrated in FIG. 4 are extended to an integer multiple.

The output unit 123 includes the multiplexer circuit MUX that receives outputs of the respective DA conversion circuits DA1 to DA4 and amplifiers AP1 to AP4 that respectively and individually receive four systems of outputs of the multiplexer circuit MUX.

In FIG. 4, the DA conversion circuit DA1 is coupled to the R-GMA 1301, and receives the gradation reference voltages VR1 to VR256 steadily generated in the R-GMA 1301. The DA conversion circuit DA1 selects a gradation reference voltage corresponding to a luminance level represented by the pixel data U1 among the gradation reference voltages VR1 to VR256, and supplies this to the multiplexer circuit MUX as the gradation voltage E1.

The DA conversion circuits DA2 and DA4 are coupled to the G-GMA 1302, and each receive the gradation reference voltages VG1 to VG256 steadily generated in the G-GMA 1302. The DA conversion circuit DA2 selects a gradation reference voltage corresponding to a luminance level represented by the pixel data U2 among the gradation reference voltages VG1 to VG256, and supplies this to the multiplexer circuit MUX as the gradation voltage E2. The DA conversion circuit DA4 selects a gradation reference voltage corresponding to a luminance level represented by the pixel data U4 among the gradation reference voltages VG1 to VG256, and supplies this to the multiplexer circuit MUX as the gradation voltage E4.

The DA conversion circuit DA3 is coupled to the B-GMA 1303, and receives the gradation reference voltages VB1 to VB256 steadily generated in the B-GMA 1303. The DA conversion circuit DA3 selects a gradation reference voltage corresponding to a luminance level represented by the pixel data U3 among the gradation reference voltages VB1 to VB256, and supplies this to the multiplexer circuit MUX as the gradation voltage E3.

The multiplexer circuit MUX assigns the gradation voltages E1 to E4 to the respective gradation voltages P1 to P4 in a mode according to the output switching signals Sa and Sb supplied from the output control unit 124, and supplies the gradation voltages P1 to P4 to the amplifiers AP1 to AP4.

Since the display panel 20*a* has the PenTile matrix and is of the time-divisionally driven type with the division number "2," the output control unit 124 receives the division number setting signal DVN indicating the division number "2" and the cell arrangement signal CAS indicating the PenTile matrix. The output control unit 124 supplies the multiplexer circuit MUX with the output switching signals Sa and Sb that cause the gradation voltages E1 to E4 to be assigned to the respective gradation voltages P1 to P4 in the mode illustrated in FIG. 5 according to the division number setting signal DVN and the cell arrangement signal CAS and the gradation voltages P1 to P4 to be output. Furthermore, the output control unit 124 supplies the display panel 20*a* with the input switching signals SA and SB that control the demultiplexer unit 200 included in the display panel 20*a* according to the division number setting signal DVN and the cell arrangement signal CAS. That is, the output control unit 124 generates the input switching signals SA and SB that cause the driving voltage signals G1 to G4 to be input in turn to the respective data lines D of two, which is as many as the division number "2," at a cycle of the division periods obtained by dividing one horizontal scanning period by the division number "2" for the respective driving voltage signals G1 to G4 corresponding to the respective gradation voltages P1 to P4 according to the division number setting signal DVN and the cell arrangement signal CAS. The output control unit 124 outputs the input switching signals SA and SB to the display panel 20*a*.

According to the above-described output switching signals Sa and Sb, as illustrated in FIG. 5, in an N-th (N is an integer of 1 to n) horizontal scanning period, in a first division period as the first one of the first and second division periods obtained by dividing the N-th horizontal scanning period by two, the multiplexer circuit MUX outputs the gradation voltage E1 as the gradation voltage P1, outputs the gradation voltage E3 as the gradation voltage P2, outputs the gradation voltage E2 as the gradation voltage P3, and outputs the gradation voltage E4 as the gradation voltage P4.

As illustrated in FIG. 5, in the N-th (N is an integer of 1 to n) horizontal scanning period, in the second division period that follows the above-described first division period, the multiplexer circuit MUX outputs the gradation voltage E2 as the gradation voltage P1, outputs the gradation voltage E4 as the gradation voltage P2, outputs the gradation voltage E1 as the gradation voltage P3, and outputs the gradation voltage E3 as the gradation voltage P4.

As illustrated in FIG. 5, in a (N+1)-th horizontal scanning period, in the first division period as the first one of the periods obtained by dividing the (N+1)-th horizontal scanning period by two, the multiplexer circuit MUX outputs the gradation voltage E3 as the gradation voltage P1, outputs the gradation voltage E1 as the gradation voltage P2, outputs the gradation voltage E2 as the gradation voltage P3, and outputs the gradation voltage E4 as the gradation voltage P4.

As illustrated in FIG. 5, in the (N+1)-th horizontal scanning period, in a second division period that follows the above-described first period, the multiplexer circuit MUX outputs the gradation voltage E2 as the gradation voltage P1, outputs the gradation voltage E4 as the gradation voltage P2, outputs the gradation voltage E3 as the gradation voltage P3, and outputs the gradation voltage E1 as the gradation voltage P4.

The amplifiers AP1 to AP4 receive the gradation voltages P1 to P4, and output each of respectively and individually amplified signals to the display panel 20*a* as the driving voltage signals G1 to G4.

The demultiplexer unit 200 included in the display panel 20*a* includes the demultiplexer circuit DMX having switches SW1A to SW4A and SW1B to SW4B that respectively and individually receive the driving voltage signals G1 to G4.

As illustrated in FIG. 4, the switches SW1A and SW1B both receive the driving voltage signal G1. The switch SW1A supplies the driving voltage signal G1 to the data line D1 when it is in ON state, and sets the data line D1 to open state when it is in OFF state. The switch SW1B supplies the driving voltage signal G1 to the data line D2 when it is in ON state, and sets the data line D2 to open state when it is in OFF state.

The switches SW2A and SW2B both receive the driving voltage signal G2. The switch SW2A supplies the driving voltage signal G2 to the data line D3 when it is in ON state, and sets the data line D3 to open state when it is in OFF state. The switch SW2B supplies the driving voltage signal G2 to the data line D4 when it is in ON state, and sets the data line D4 to open state when it is in OFF state.

The switches SW3A and SW3B both receive the driving voltage signal G3. The switch SW3A supplies the driving voltage signal G3 to the data line D6 when it is in ON state, and sets the data line D6 to open state when it is in OFF state. The switch SW3B supplies the driving voltage signal G3 to the data line D5 when it is in ON state, and sets the data line D5 to open state when it is in OFF state.

The switches SW4A and SW4B both receive the driving voltage signal G4. The switch SW4A supplies the driving voltage signal G4 to the data line D8 when it is in ON state, and sets the data line D8 to open state when it is in OFF state. The switch SW4B supplies the driving voltage signal G4 to the data line D7 when it is in ON state, and sets the data line D7 to open state when it is in OFF state.

As illustrated in FIG. 4, the switches SW1A to SW4A receive the input switching signal SA output from the output control unit 124, and are controlled on and off by the input switching signal SA as illustrated in FIG. 5. The switches SW1B to SW4B receive the input switching signal SB output from the output control unit 124, and are controlled on and off by the input switching signal SB as illustrated in FIG. 5.

That is, as illustrated in FIG. 5, the switches SW1A, SW2A, SW3A, and SW4A are set to ON state in the first division period in each of the N-th and the (N+1)-th horizontal scanning periods and to OFF state in the second division period according to the input switching signal SA. The switches SW1B, SW2B, SW3B, and SW4B are set to OFF state in the first division period in each of the N-th and the (N+1)-th horizontal scanning periods and to ON state in the second division period according to the input switching signal SB.

Accordingly, with the operations of the multiplexer circuit MUX and the switches SW1A to SW4A and SW1B to SW4B included in the demultiplexer circuit DMX illustrated in FIG. 4, in the first division period in the (N)-th horizontal scanning period, the driving voltage signal G1 having the gradation voltage E1 according to the gamma correction characteristic of the red color component, the driving voltage signal G2 having the gradation voltage E3 according to the gamma correction characteristic of the blue color component, the driving voltage signal G3 having the gradation voltage E2 according to the gamma correction characteristic of the green color component, and the driving voltage signal G4 having the gradation voltage E4 according to the gamma correction characteristic of the green color component, are respectively supplied to the red display cell Pr, the blue display cell Pb, the green display cell Pg, and the green display cell Pg, on a (N)-th row via the respective data lines D1, D3, D6, and D8.

In the second division period in the (N)-th horizontal scanning period, the driving voltage signal G1 having the gradation voltage E2 according to the gamma correction characteristic of the green color component, the driving voltage signal G2 having the gradation voltage E4 according to the gamma correction characteristic of the green color component, the driving voltage signal G3 having the gradation voltage E1 according to the gamma correction characteristic of the red color component, and the driving voltage signal G4 having the gradation voltage E3 according to the gamma correction characteristic of the blue color component, are respectively supplied to the green display cell Pg, the green display cell Pg, the red display cell Pr, and the blue display cell Pb, on the (N)-th row via the respective data lines D2, D4, D5, and D7.

In the first division period in the (N+1)-th horizontal scanning period, the driving voltage signal G1 having the gradation voltage E3 according to the gamma correction characteristic of the blue color component, the driving voltage signal G2 having the gradation voltage E1 according to the gamma correction characteristic of the red color component, the driving voltage signal G3 having the gradation voltage E2 according to the gamma correction characteristic of the green color component, and the driving voltage signal G4 having the gradation voltage E4 according to the gamma correction characteristic of the green color component, are respectively supplied to the blue display cell Pb, the red display cell Pr, the green display cell Pg, and the green display cell Pg, on a (N+1)-th row via the respective data lines D1, D3, D6, and D8.

In the second division period in the (N+1)-th horizontal scanning period, the driving voltage signal G1 having the gradation voltage E2 according to the gamma correction characteristic of the green color component, the driving voltage signal G2 having the gradation voltage E4 according to the gamma correction characteristic of the green color component, the driving voltage signal G3 having the gradation voltage E3 according to the gamma correction characteristic of the blue color component, and the driving voltage signal G4 having the gradation voltage E1 according to the gamma correction characteristic of the red color component, are respectively supplied to the green display cell Pg, the green display cell Pg, the blue display cell Pb, and the red display cell Pr, on the (N+1)-th row via the respective data lines D2, D4, D5, and D7.

Next, a description will be given with one example of an operation of the data driver 12 when the display panel that has the PenTile matrix and is of the normally driven type is driven.

[PenTile Matrix, Normally Driven]

Figure 6:
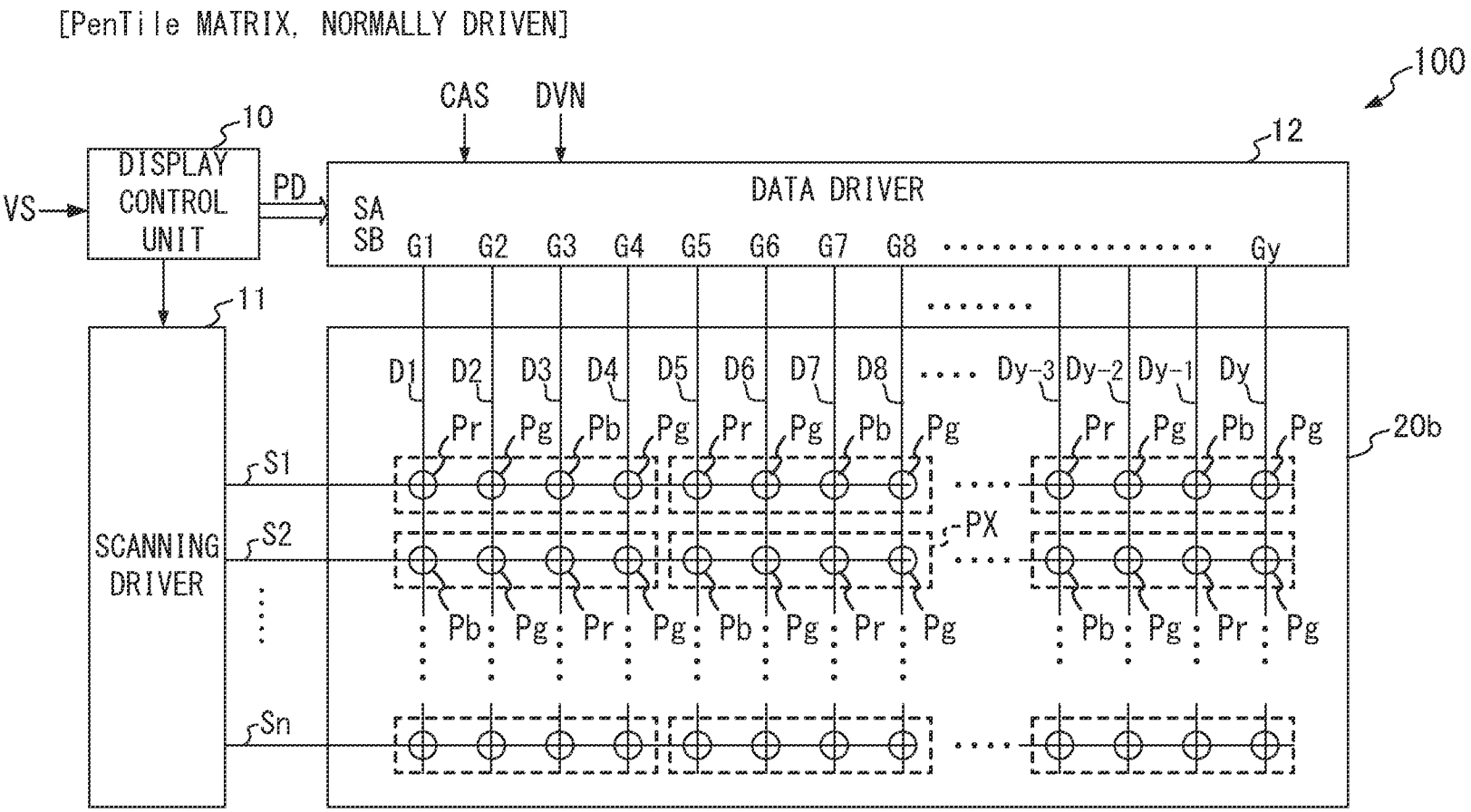
FIG. 6 is a block diagram illustrating a configuration of the display apparatus 100 including a display panel 20*b* that has the PenTile matrix and is of a normally driven type.

FIG. 6 is a block diagram illustrating a configuration of the display apparatus 100 including a display panel 20*b* that has the PenTile matrix and is of the normally driven type.

The display control unit 10 and the scanning driver 11 illustrated in FIG. 6 are the same as those illustrated in FIG. 1, thus omitting the description of the operations. Furthermore, the internal configuration of the data driver 12 is the same as that illustrated in FIG. 2, thus omitting the detailed description of the operation.

As illustrated in FIG. 6, the display panel 20*b* is the display panel 20*a* illustrated in FIG. 3 from which the demultiplexer unit 200 is eliminated, and has a configuration in which the data lines D1 to Dy receive the respective driving voltage signals G1 to Gy output from the data driver 12. The configuration of the cell group PX and the arrangement of each display cell (Pr, Pg, Pb) are the same as those illustrated in FIG. 3.

Figure 7:
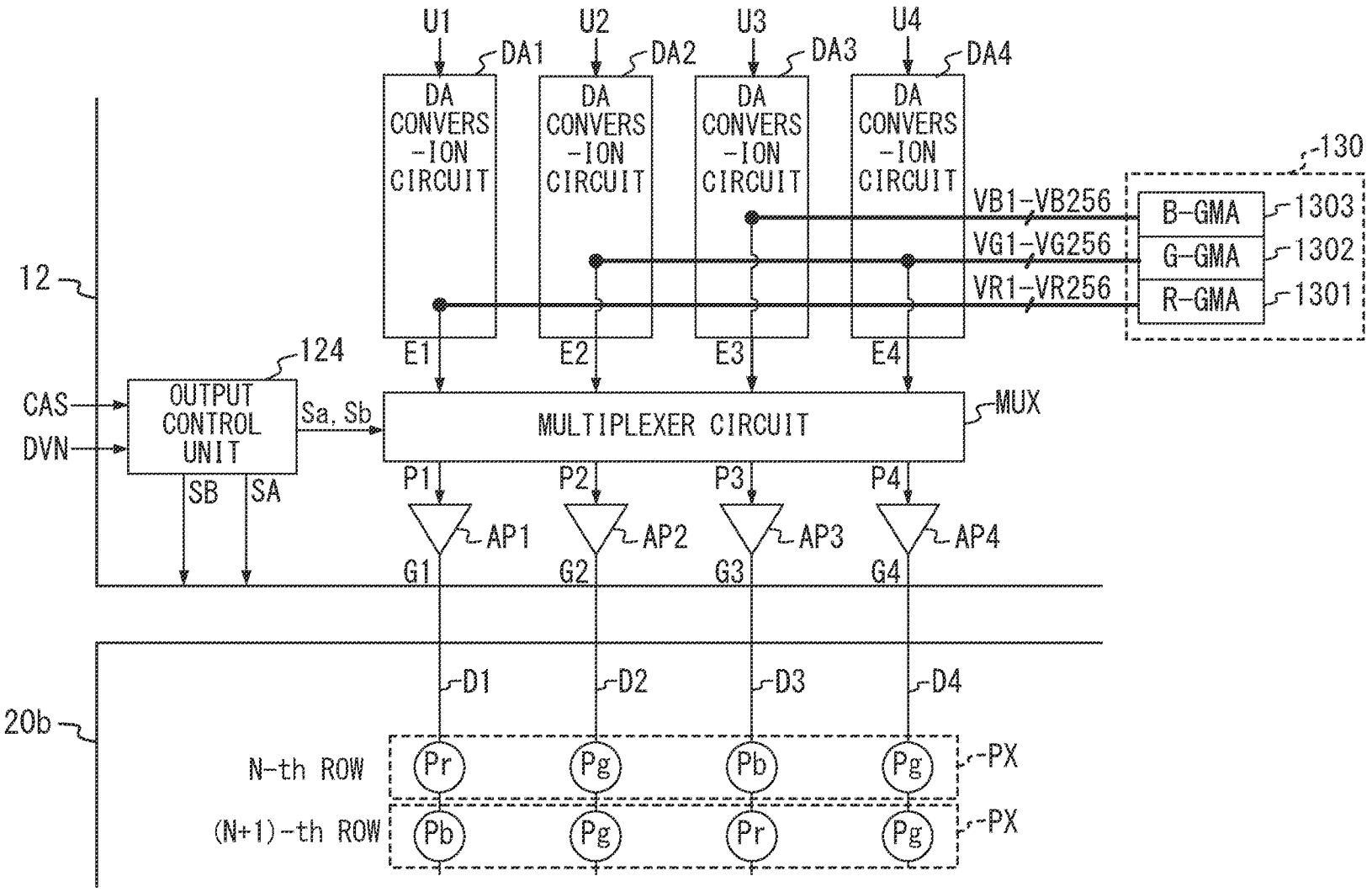
FIG. 7 is a block diagram excerpting and illustrating circuit blocks involved in the driving voltage signals G1 to G4 from each of the data driver 12 and the display panel 20*b;*

FIG. 7 is a block diagram excerpting and illustrating circuit blocks involved in the driving voltage signals G1 to G4 from the data driver 12 and the display panel 20*b*. Note that, respective operations of the DA conversion circuits DA1 to DA4, the gradation reference voltage generating unit 130, and the amplifiers AP1 to AP4 illustrated in FIG. 7 are the same as those illustrated in FIG. 4, thus omitting the detailed description.

Since the display panel 20*b* has the PenTile matrix and is of the normally driven type, the output control unit 124 receives the division number setting signal DVN indicating the division number "1" and the cell arrangement signal CAS indicating the PenTile matrix. The output control unit 124 supplies the multiplexer circuit MUX with the output switching signals Sa and Sb that cause the gradation voltages E1 to E4 output from the DA conversion circuit DA1 to DA4 to be assigned to the respective gradation voltages P1 to P4 in the mode illustrated in FIG. 8 according to the division number setting signal DVN and the cell arrangement signal CAS and the gradation voltages P1 to P4 to be output. Note that, when the division number setting signal DVN that indicates the division number "1" is received, that is, when it is indicated that the display panel 20*b* is of the normally driven type, the output control unit 124 stops a generation operation of the above-described input switching signals SA and SB.

As illustrated in FIG. 8, in the N-th (N is an integer of 1 to n) horizontal scanning period, this causes the multiplexer circuit MUX to output the gradation voltage E1 as the gradation voltage P1, output the gradation voltage E2 as the gradation voltage P2, output the gradation voltage E3 as the gradation voltage P3, and output the gradation voltage E4 as the gradation voltage P4.

The amplifiers AP1 to AP4 output signals obtained by respectively and individually amplifying the gradation voltages P1 to P4 to the display panel 20*a* as the respective driving voltage signals G1 to G4.

Accordingly, with the operation of the multiplexer circuit MUX, in the (N)-th horizontal scanning period, the driving voltage signal G1 having the gradation voltage E1 according to the gamma correction characteristic of the red color component, the driving voltage signal G2 having the gradation voltage E2 according to the gamma correction characteristic of the green color component, the driving voltage signal G3 having the gradation voltage E3 according to the gamma correction characteristic of the blue color component, and the driving voltage signal G4 having the gradation voltage E4 according to the gamma correction characteristic of the green color component, are respectively supplied to the red display cell Pr, the green display cell Pg, the blue display cell Pb, and the green display cell Pg, on the (N)-th row via the respective data lines D1, D2, D3, and D4.

In the (N+1)-th horizontal scanning period, the driving voltage signal G1 having the gradation voltage E3 according to the gamma correction characteristic of the blue color component, the driving voltage signal G2 having the gradation voltage E2 according to the gamma correction characteristic of the green color component, the driving voltage signal G3 having the gradation voltage E1 according to the gamma correction characteristic of the red color component, and the driving voltage signal G4 having the gradation voltage E4 according to the gamma correction characteristic of the green color component, are respectively supplied to the blue display cell Pb, the green display cell Pg, the red display cell Pr, and the green display cell Pg, on the (N+1)-th row via the respective data lines D1, D2, D3, and D4.

Next, a description will be given with one example of an operation of the data driver 12 when the display panel that has the RGB stripe arrangement configured of three color components of RGB and is of the time-divisionally driven type.

[RGB Stripe Arrangement, Time-Divisionally Driven (Division Number "2")]

Figure 9:
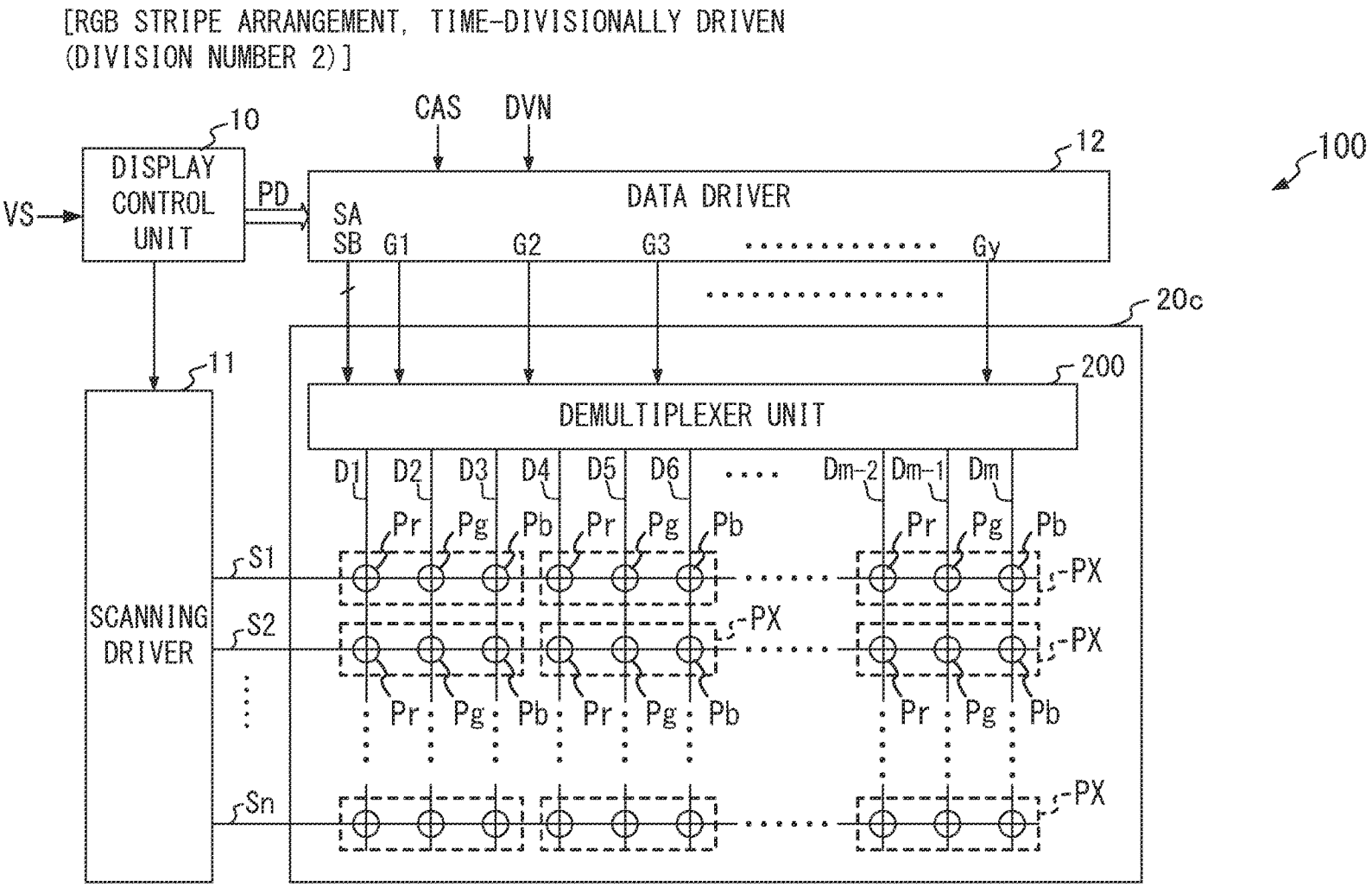
FIG. 9 is a block diagram illustrating a configuration of the display apparatus 100 including a display panel 20*c* that has an RGB stripe arrangement and is of a time-divisionally driven type with a division number "2;"

FIG. 9 is a block diagram illustrating a configuration of the display apparatus 100 including a display panel 20*c* having the RGB stripe arrangement and is of the time-divisionally driven type with the division number "2." Note that the display control unit 10 and the scanning driver 11 illustrated in FIG. 9 are the same as those illustrated in FIG. 1, thus omitting the description of the operations. Furthermore, the internal configuration of the data driver 12 is the same as that illustrated in FIG. 2, thus omitting the detailed description of the operation.

As illustrated in FIG. 9, the display panel 20*c* includes the demultiplexer unit 200, n horizontal scanning lines S1 to Sn that extend in the horizontal direction of the two-dimensional screen, and m data lines D1 to Dm that extend in the perpendicular direction of the two-dimensional screen. In the regions of the intersecting portions between the horizontal scanning lines and the data lines, the red display cell Pr functioning for displaying the red color, the green display cell Pg functioning for displaying the green color, or the blue display cell Pb functioning for displaying the blue color are formed. In the display panel 20*c*, three display cells adjacent to one another on each of the horizontal scanning lines S1 to Sn form one cell group PX (regions surrounded by dashed lines) corresponding to the driving. Note that the arrangement configuration of the three display cells in each cell group PX is, as illustrated in FIG. 9, an arrangement in which the red display cell Pr, the green display cell Pg, and the blue display cell Pb are arranged side by side in this order on each of the horizontal scanning lines S1 to Sn. Note that, in the stripe arrangement, one color pixel is configured by the above-described cell group PX.

The demultiplexer unit 200 receive the driving voltage signals G1 to Gy and the input switching signals SA and SB output from the data driver 12. The demultiplexer unit 200 supplies the driving voltage signals G1 to Gy output from the data driver 12 to y data lines among the data lines D1 to Dm in accordance with the input switching signals SA and SB.

Figure 10:
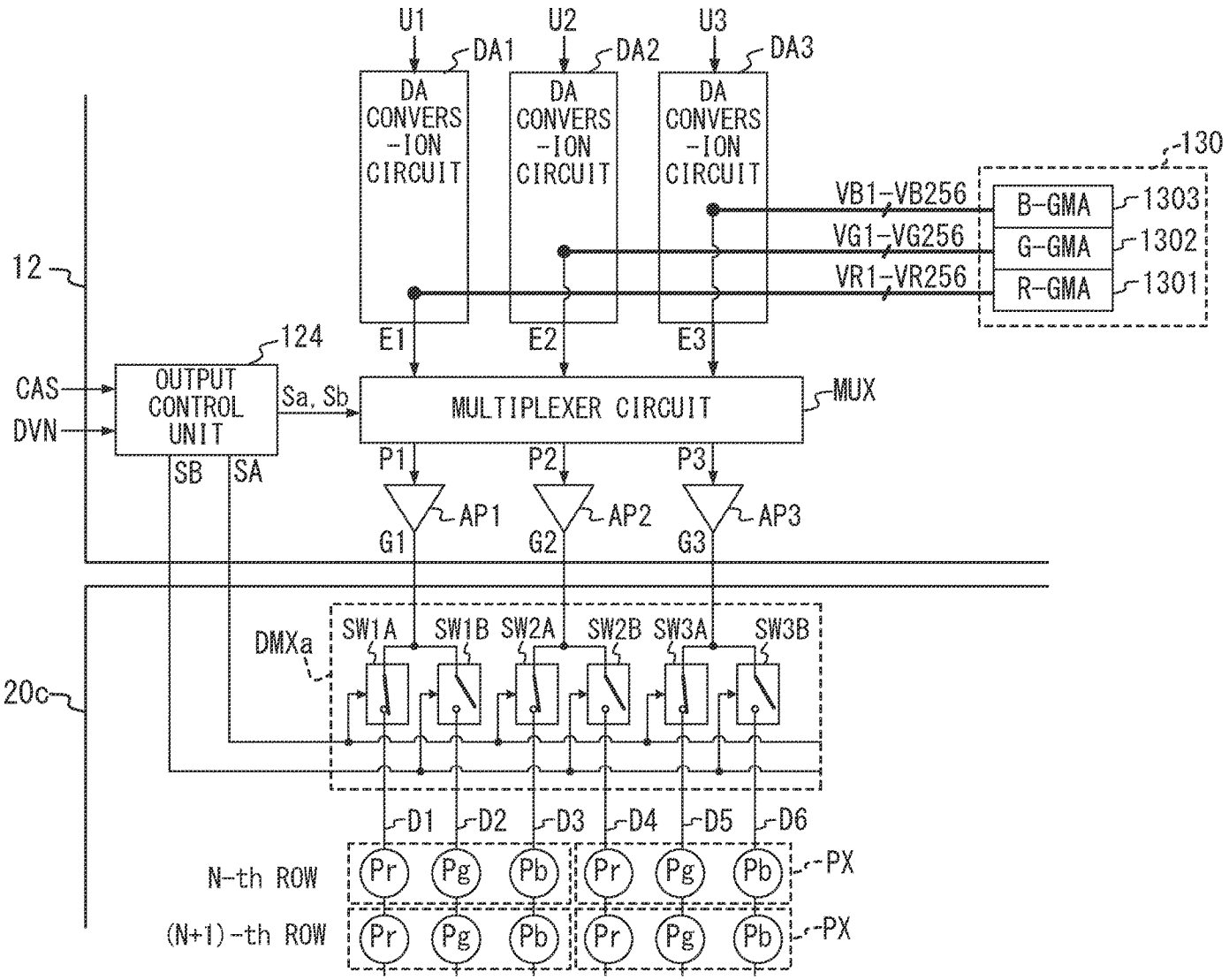
FIG. 10 is a block diagram excerpting and illustrating circuit blocks involved in the driving voltage signals G1 to G3 from each of the data driver 12 and the display panel 20*c;*

FIG. 10 is a block diagram excerpting and illustrating circuit blocks involved in the driving voltage signals G1 to G3 from each of the data driver 12 and the display panel 20*c*. The DA conversion unit 122 includes three DA conversion circuits DA1 to DA3 in a minimum group configuration in the RGB stripe arrangement, as illustrated in FIG. 10. Similarly to FIG. 4, also in FIG. 10, for the convenience of the drawing, the DA conversion unit 122 and the output unit 123 are illustrated in a minimum group configuration, but the actual configuration is a configuration in which the minimum group configurations illustrated in FIG. 10 are extended to an integer multiple. The respective operations of the DA conversion circuits DA1 to DA3 illustrated in FIG. 10, the gradation reference voltage generating unit 130, and the amplifiers AP1 to AP3 are the same as those illustrated in FIG. 4, thus omitting the detailed descriptions.

Since the display panel 20*c* has the RGB stripe arrangement and is of the time-divisionally driven type with the division number "2," the output control unit 124 receive the division number setting signal DVN indicating the division number "2" and the cell arrangement signal CAS indicating the RGB stripe arrangement. The output control unit 124 supplies the multiplexer circuit MUX with the output switching signals Sa and Sb that cause the gradation voltages E1 to E3 output from the DA conversion circuits DA1 to DA3 to be assigned to the respective gradation voltages P1 to P3 in the mode illustrated in FIG. 11 according to the division number setting signal DVN and the cell arrangement signal CAS and the gradation voltages P1 to P3 to be output. Furthermore, the output control unit 124 supplies the input switching signals SA and SB that control the demultiplexer unit 200 included in the display panel 20*c* to the display panel 20*c* according to the division number setting signal DVN and the cell arrangement signal CAS. That is, the output control unit 124 generates the input switching signals SA and SB that cause the driving voltage signals G1 to G3 to be input in turn to the respective data lines D of two, which is as many as the division number "2," at a cycle of the division periods obtained by dividing one horizontal scanning period by the division number "2" for the respective driving voltage signals G1 to G3 corresponding to the respective gradation voltages P1 to P3 according to the division number setting signal DVN and the cell arrangement signal CAS. The output control unit 124 outputs the input switching signals SA and SB to the display panel 20*c*.

According to the output switching signals Sa and Sb, as illustrated in FIG. 11, in the N-th horizontal scanning period, in the first division period as the first one of the first and second division periods obtained by dividing the N-th horizontal scanning period by two, the multiplexer circuit MUX outputs the gradation voltage E1 as the gradation voltage P1, outputs the gradation voltage E3 as the gradation voltage P2, and outputs the gradation voltage E2 as the gradation voltage P3.

As illustrated in FIG. 11, in the N-th horizontal scanning period, in the second division period following the above-described first division period, the multiplexer circuit MUX outputs the gradation voltage E2 as the gradation voltage P1, outputs the gradation voltage E1 as the gradation voltage P2, and outputs the gradation voltage E3 as the gradation voltage P3.

As illustrated in FIG. 11, in the (N+1)-th horizontal scanning period, in the first division period as the first one of the periods obtained by dividing the (N+1)-th horizontal scanning period by two, the multiplexer circuit MUX outputs the gradation voltage E1 as the gradation voltage P1, outputs the gradation voltage E3 as the gradation voltage P2, and outputs the gradation voltage E2 as the gradation voltage P3.

As illustrated in FIG. 11, in the (N+1)-th horizontal scanning period, in the second division period following the above-described first division period, the multiplexer circuit MUX outputs the gradation voltage E2 as the gradation voltage P1, outputs the gradation voltage E1 as the gradation voltage P2, and outputs the gradation voltage E3 as the gradation voltage P3.

The amplifiers AP1 to AP3 output the respective signals obtained by receiving and respectively and individually amplifying the gradation voltages P1 to P3 to the display panel 20*c* as the driving voltage signals G1 to G3.

The demultiplexer unit 200 included in the display panel 20*c* includes a demultiplexer circuit DMXa constituted of the switches SW1A to SW3A and SW1B to SW3B that respectively and individually receive the driving voltage signals G1 to G3.

As illustrated in FIG. 10, the switch SW1A and SW1B both receive the driving voltage signal G1. The switch SW1A supplies the driving voltage signal G1 to the data line D1 when it is in ON state, and sets the data line D1 to open state when it is in OFF state. The switch SW1B supplies the driving voltage signal G1 to the data line D2 when it is in ON state, and sets the data line D2 to open state when it is in OFF state.

The switches SW2A and SW2B both receive the driving voltage signal G2. The switch SW2A supplies the driving voltage signal G2 to the data line D3 when it is in ON state, and sets the data line D3 to open state when it is in OFF state. The switch SW2B supplies the driving voltage signal G2 to the data line D4 when it is in ON state, and sets the data line D4 to open state when it is in OFF state.

The switches SW3A and SW3B both receive the driving voltage signal G3. The switch SW3A supplies the driving voltage signal G3 to the data line D5 when it is in ON state, and sets the data line D5 to open state when it is in OFF state. The switch SW3B supplies the driving voltage signal G3 to the data line D6 when it is in ON state, and sets the data line D6 to open state when it is in OFF state.

As illustrated in FIG. 11, the switches SW1A to SW3A receive the input switching signal SA output from the output control unit 124 and are controlled on and off by the input switching signal SA as illustrated in FIG. 11. The switches SW1B to SW3B receive the input switching signal SB output from the output control unit 124 and are controlled on and off by the input switching signal SB as illustrated in FIG. 11.

That is, as illustrated in FIG. 11, the switches SW1A, SW2A, and SW3A are set to ON state in the first division period in each of the N-th and the (N+1)-th horizontal scanning periods and to OFF state in the second division period according to the input switching signal SA. The switches SW1B, SW2B, and SW3B are set to OFF state in the first division period in each of the N-th and the (N+1)-th horizontal scanning periods and to ON state in the second division period according to the input switching signal SB.

Accordingly, with the operations of the multiplexer circuit MUX and the demultiplexer circuit DMXa including the switches SW1A to SW3A and SW1B to SW3B illustrated in FIG. 10, in the first division period in the (N)-th horizontal scanning period, the driving voltage signal G1 having the gradation voltage E1 according to the gamma correction characteristic of the red color component, the driving voltage signal G2 having the gradation voltage E3 according to the gamma correction characteristic of the blue color component, and the driving voltage signal G3 having the gradation voltage E2 according to the gamma correction characteristic of the green color component, are respectively supplied to the red display cell Pr, the blue display cell Pb, and the green display cell Pg, on the (N)-th row via the respective data lines D1, D3, and D5.

In the second division period in the (N)-th horizontal scanning period, the driving voltage signal G1 having the gradation voltage E2 according to the gamma correction characteristic of the green color component, the driving voltage signal G2 having the gradation voltage E1 according to the gamma correction characteristic of the red color component, and the driving voltage signal G3 having the gradation voltage E3 according to the gamma correction characteristic of the blue color component, are respectively supplied to the green display cell Pg, the red display cell Pr, and the blue display cell Pb, on the (N)-th row via the respective data lines D2, D4, and D6.

In the first division period in the (N+1)-th horizontal scanning period, the driving voltage signal G1 having the gradation voltage E1 according to the gamma correction characteristic of the red color component, the driving voltage signal G2 having the gradation voltage E3 according to the gamma correction characteristic of the blue color component, and the driving voltage signal G3 having the gradation voltage E2 according to the gamma correction characteristic of the green color component, are respectively supplied to the red display cell Pr, the blue display cell Pb, and the green display cell Pg, on the (N+1)-th row via the respective data lines D1, D3, and D5.

In the second division period in the (N+1)-th horizontal scanning period, the driving voltage signal G1 having the gradation voltage E2 according to the gamma correction characteristic of the green color component, the driving voltage signal G2 having the gradation voltage E1 according to the gamma correction characteristic of the red color component, and the driving voltage signal G3 having the gradation voltage E3 according to the gamma correction characteristic of the blue color component, are respectively supplied to the green display cell Pg, the red display cell Pr, and the blue display cell Pb, on the (N+1)-th row via the respective data lines D2, D4, and D6.

Next, a description will be given with one example of an operation of the data driver 12 when the display panel that has the RGB stripe arrangement and is of the normally driven type is driven.

[RGB Stripe Arrangement, Normally Driven]

Figure 12:
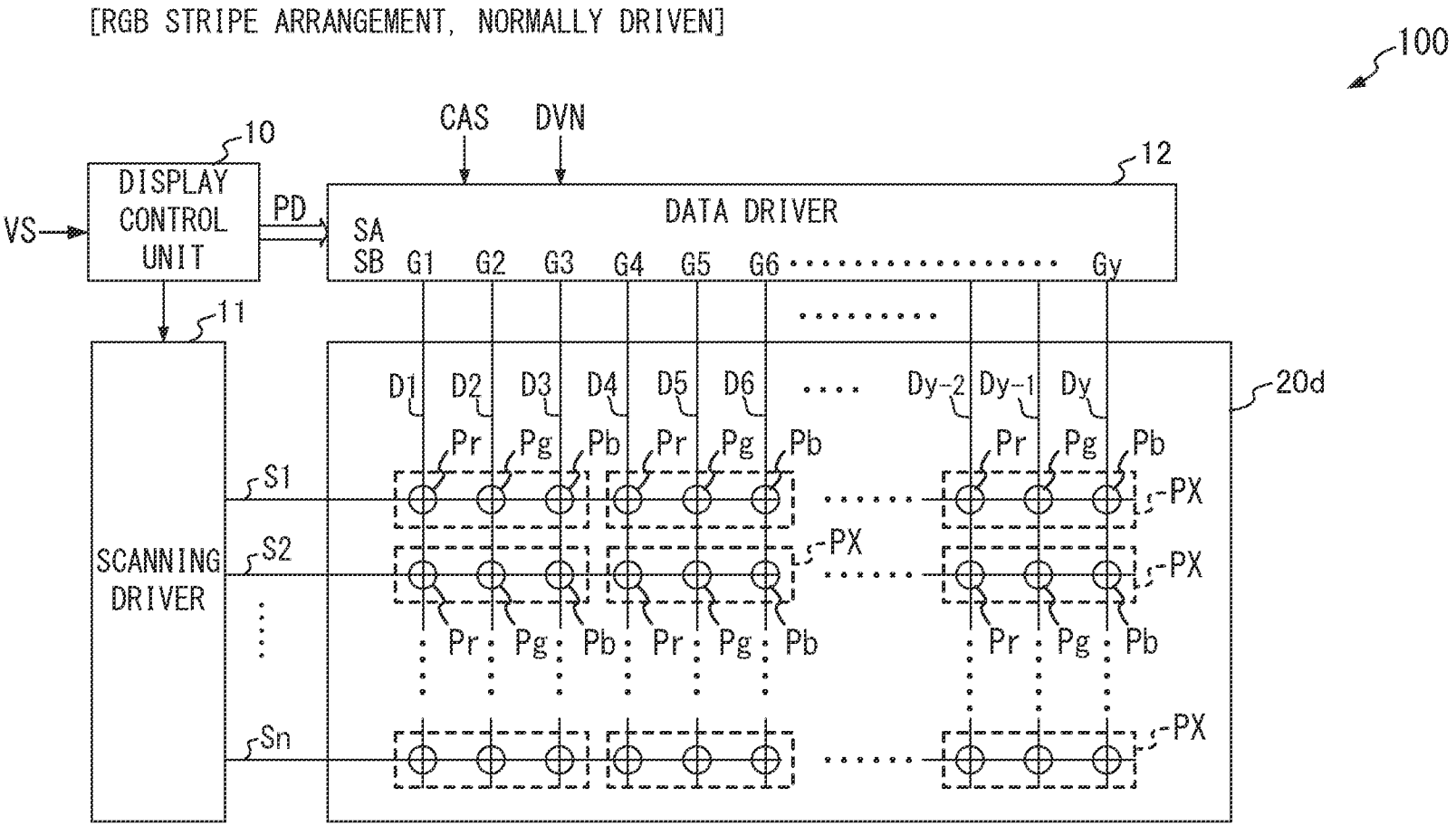
FIG. 12 is a block diagram illustrating a configuration of the display apparatus 100 including a display panel 20*d* that has the RGB stripe arrangement and is of a normally driven type.

FIG. 12 is a block diagram illustrating a configuration of the display apparatus 100 including a display panel 20*d* that has the RGB stripe arrangement and is of the normally driven type.

Note that the display control unit 10 and the scanning driver 11 illustrated in FIG. 12 are the same as those illustrated in FIG. 1, thus omitting the description of the operations. Furthermore, the internal configuration of the data driver 12 is the same as that illustrated in FIG. 2, thus omitting the detailed description of the operation.

As illustrated in FIG. 12, the display panel 20*d* is the display panel 20*c* illustrated in FIG. 9 from which the demultiplexer unit 200 is eliminated and has a configuration in which the data lines D1 to Dy receive the respective driving voltage signals G1 to Gy output from the data driver 12. The configuration of the cell group PX and the arrangement of each display cell (Pr, Pg, Pb) are the same as those illustrated in FIG. 9.

Figure 13:
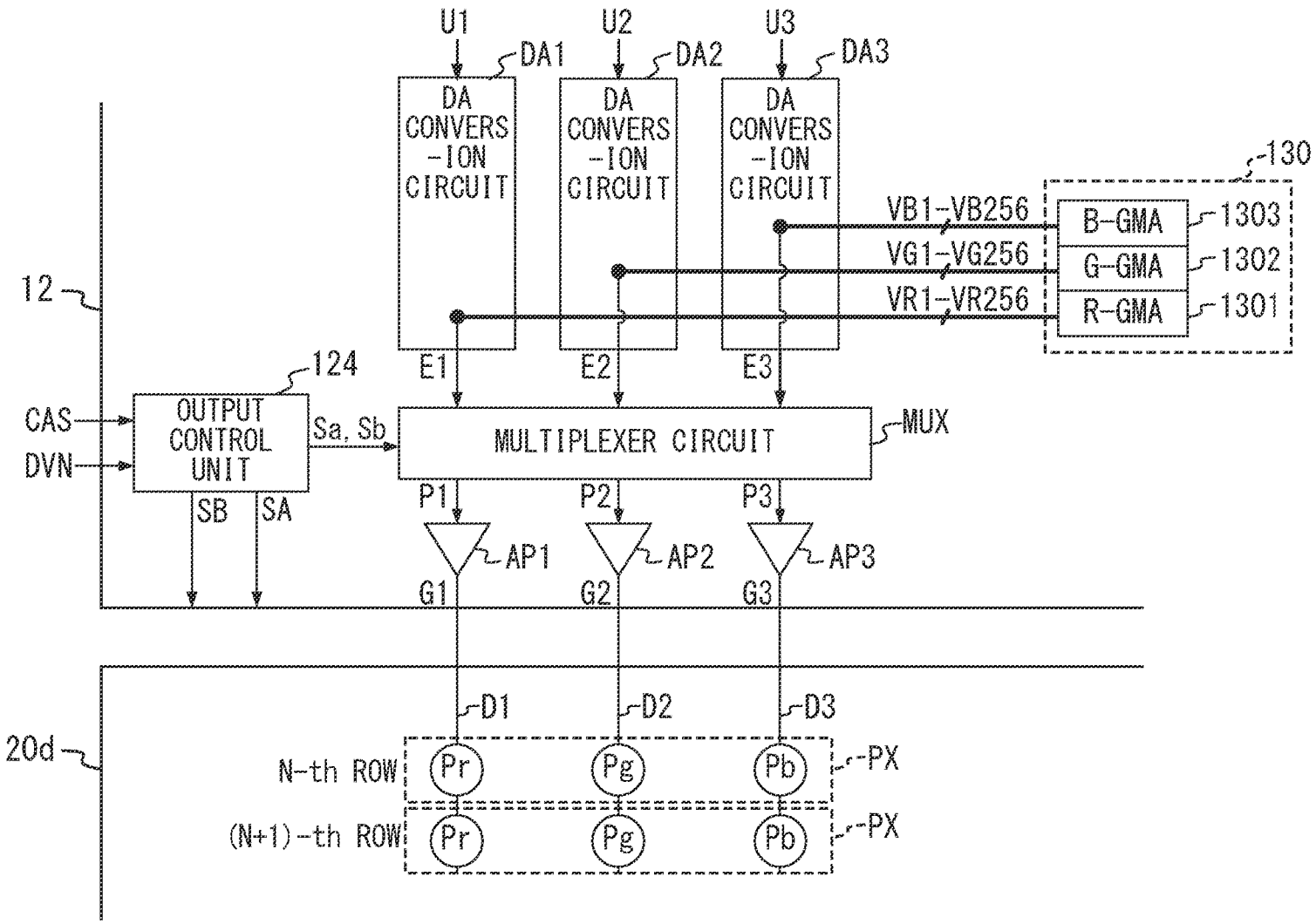
FIG. 13 is a block diagram excerpting and illustrating circuit blocks involved in the driving voltage signals G1 to G3 from each of the data driver 12 and the display panel 20*d;*

FIG. 13 is a block diagram excerpting and illustrating circuit blocks involved in the driving voltage signals G1 to G3 from each of the data driver 12 and the display panel 20*d*. Note that the respective operations of the DA conversion circuits DA1 to DA3, the gradation reference voltage generating unit 130, and the amplifiers AP1 to AP3 illustrated in FIG. 13 are the same as those illustrated in FIG. 10, thus omitting the detailed description.

Since the display panel 20*d* has the RGB stripe arrangement and is of the normally driven type, the output control unit 124 receives the division number setting signal DVN indicating the division number "1" and the cell arrangement signal CAS indicating the RGB stripe arrangement. The output control unit 124 supplies the multiplexer circuit MUX with the output switching signals Sa and Sb that cause the gradation voltages E1 to E3 output from the DA conversion circuits DA1 to DA3 to be assigned to the respective gradation voltages P1 to P3 in the mode illustrated in FIG. 14 according to the division number setting signal DVN and the cell arrangement signal CAS and the gradation voltages P1 to P3 to be output. When the division number setting signal DVN that indicates the division number "1" is received, that is, when it is indicated that the display panel 20*d* is of the normally driven type, the output control unit 124 stops the generation operation of the above-described input switching signals SA and SB.

As illustrated in FIG. 14, in each of the N-th (N is an integer of 1 to n) and the (N+1)-th horizontal scanning periods, this causes the multiplexer circuit MUX to output the gradation voltage E1 as the gradation voltage P1, output the gradation voltage E2 as the gradation voltage P2, and output the gradation voltage E3 as the gradation voltage P3.

The amplifiers AP1 to AP3 output signals obtained by respectively and individually amplifying the gradation voltages P1 to P3 to the display panel 20*d* as the respective driving voltage signals G1 to G3.

With this, in each of the (N)-th and the (N+1)-th horizontal scanning periods, the driving voltage signal G1 having the gradation voltage E1 according to the gamma correction characteristic of the red color component, the driving voltage signal G2 having the gradation voltage E2 according to the gamma correction characteristic of the green color component, and the driving voltage signal G3 having the gradation voltage E3 according to the gamma correction characteristic of the blue color component are respectively supplied to the red display cell Pr, the green display cell Pg, and the blue display cell Pb, on the (N)-th and the (N+1)-th rows via the respective data lines D1, D2, and D3.

Note that, while in the above-described embodiments (for example, FIG. 4), in the output unit 123, the multiplexer circuit MUX is disposed in the position before each amplifier (AP1 to AP4), the multiplexer circuit MUX may be disposed in a position after each amplifier (AP1 to AP4).

Figure 15:
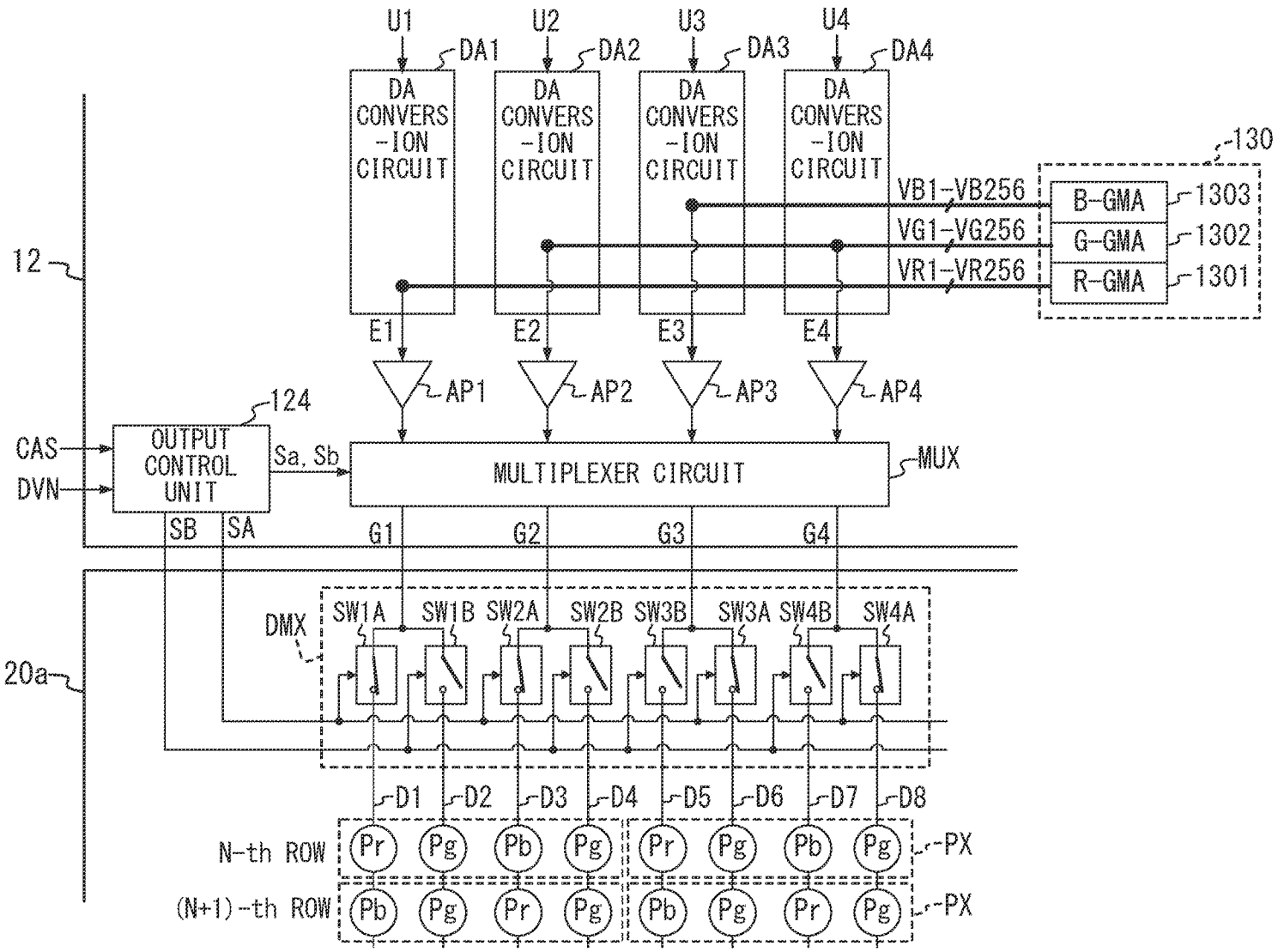
FIG. 15 is a block diagram illustrating a configuration when the multiplexer circuit MUX illustrated in FIG. 4 is disposed in a position after amplifiers AP1 to AP4.
Figure 16:
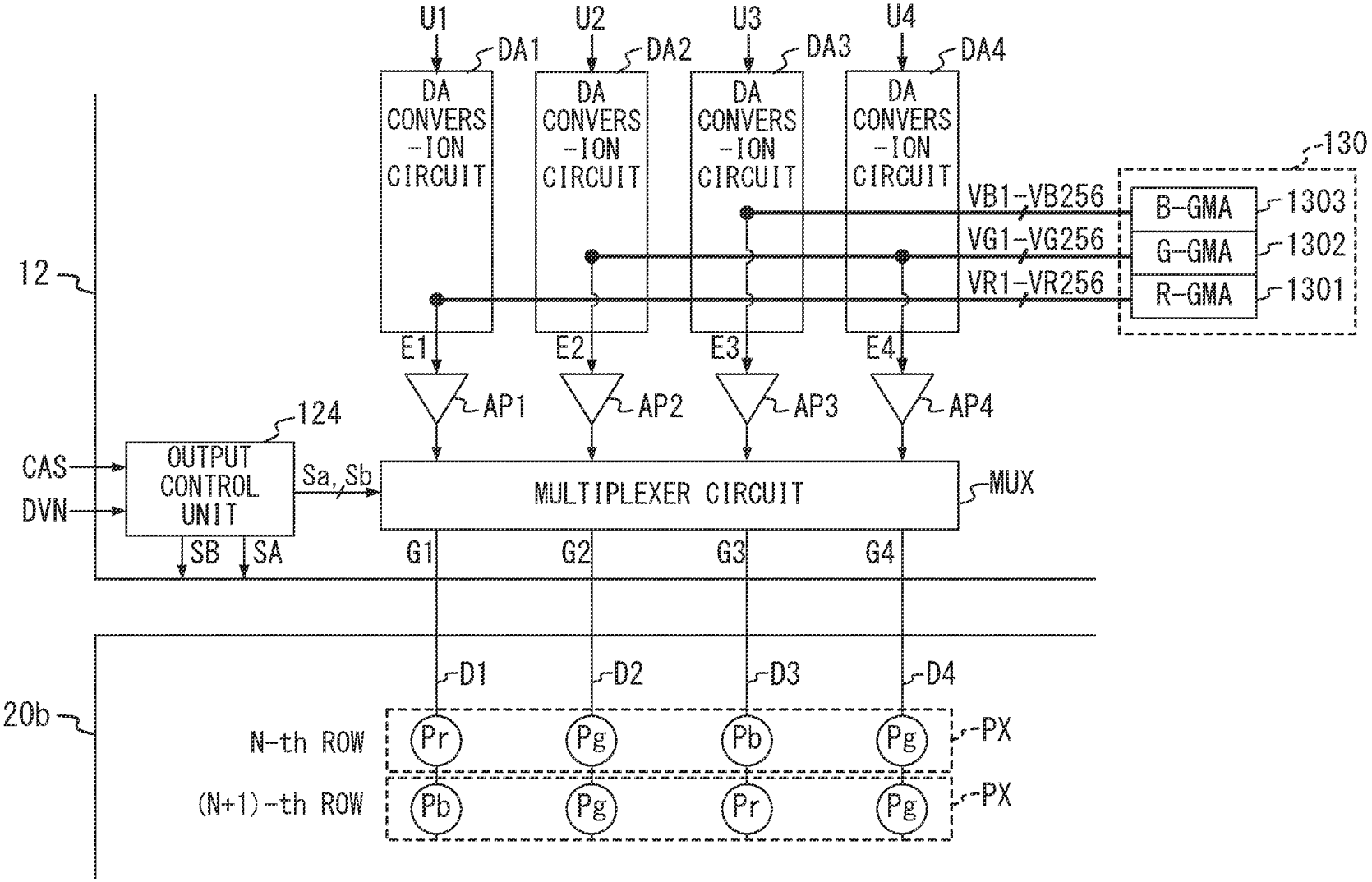
FIG. 16 is a block diagram illustrating a configuration when the multiplexer circuit MUX illustrated in FIG. 7 is disposed in a position after the amplifiers AP1 to AP4.

For example, the multiplexer circuit MUX illustrated in FIG. 4 is disposed in the position after the amplifiers AP1 to AP4 as illustrated in FIG. 15, and the multiplexer circuit MUX outputs the driving voltage signals G1 to G4 corresponding to the gradation voltages E1 to E4 to the display panel 20*a*. For example, as illustrated in FIG. 16, the multiplexer circuit MUX illustrated in FIG. 7 is disposed in the position after the amplifiers AP1 to AP4, and the multiplexer circuit MUX outputs the driving voltage signals G1 to G4 corresponding to the gradation voltages E1 to E4 to the display panel 20*b*. Similarly in the respective embodiments in FIG. 10 and FIG. 13, the locations can be switched between the multiplexer circuit MUX and each amplifier in the output unit 123.

While the above-described embodiments have described the operations when the data driver 12 drives the display panel 20*a* of the time-divisionally driven type with the division number "2," the data driver 12 can drive a display panel of the time-divisionally driven type with the division number two or more.

Figure 17:
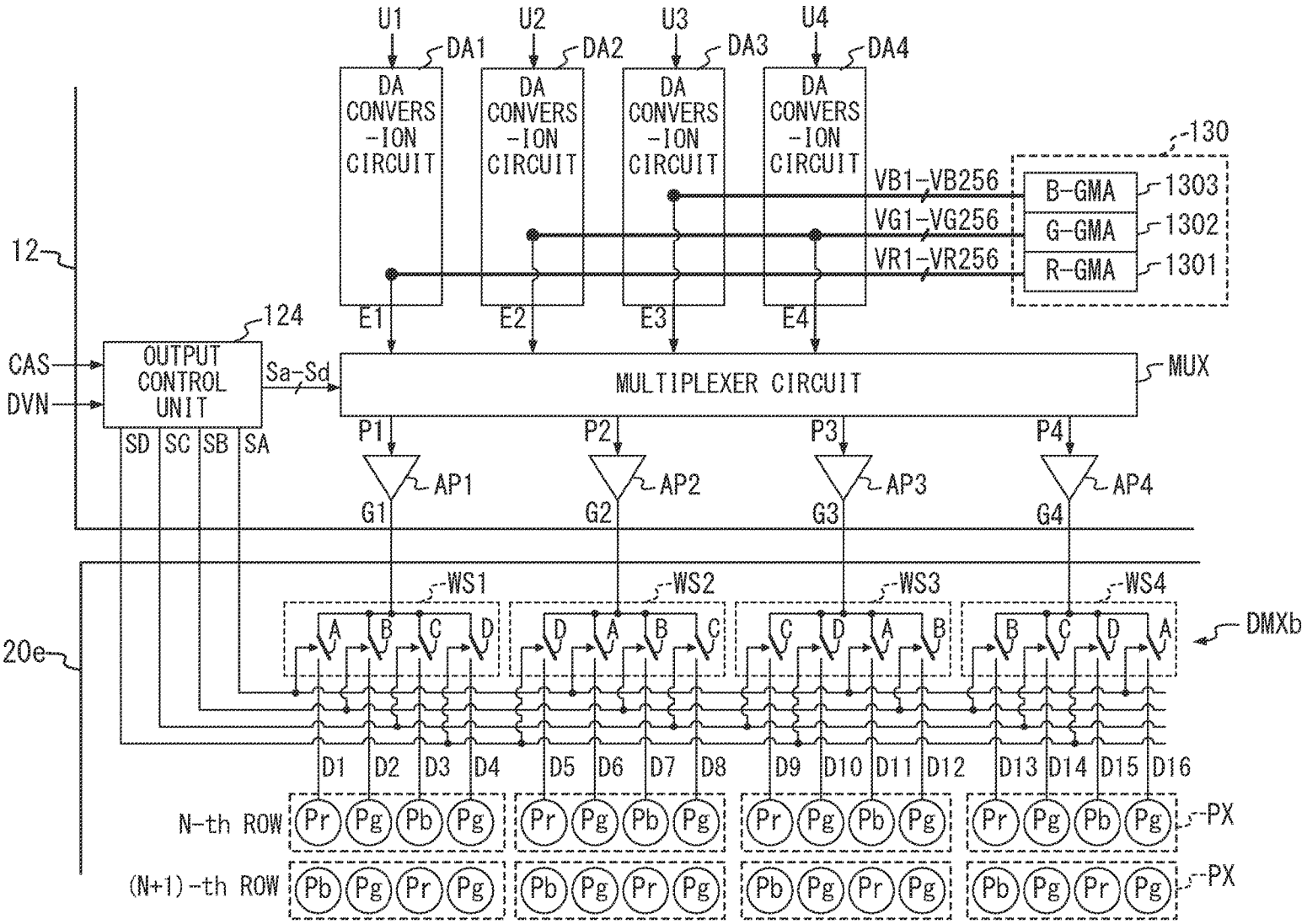
FIG. 17 is a block diagram excerpting and illustrating circuit blocks involved in the driving voltage signals G1 to G4 from each of a display panel 20*e* that has the PenTile matrix and is of a time-divisionally driven type with a division number "4" and the data driver 12.

FIG. 17 is a block diagram excerpting and illustrating circuit blocks involved in the driving voltage signals G1 to G4 from each of a display panel 20*e* that has the PenTile matrix and is of the time-divisionally driven type with the division number "4" and the data driver 12 that drives the display panel 20*e*. Similarly to FIG. 4, also in FIG. 17, for the convenience of the drawing, the DA conversion unit 122 and the output unit 123 are illustrated in a minimum group configuration, but the actual configuration is a configuration in which the minimum group configurations illustrated in FIG. 17 are extended to an integer multiple. Note that, the DA conversion circuits DA1 to DA4, the gradation reference voltage generating unit 130, and the amplifiers AP1 to AP4 illustrated in FIG. 17 are the same as those illustrated in FIG. 4, thus omitting the detailed description.

Since the display panel 20*e* has the PenTile matrix and is of the time-divisionally driven type with the division number "4," the output control unit 124 illustrated in FIG. 17 receive the division number setting signal DVN indicating the division number "4" and the cell arrangement signal CAS indicating the PenTile matrix. The output control unit 124 supplies the multiplexer circuit MUX with the output switching signals Sa, Sb, Sc, and Sd that cause the gradation voltages E1 to E4 to be assigned to the respective gradation voltages P1 to P4 in the mode illustrated in FIG. 18 according to the division number setting signal DVN and the cell arrangement signal CAS and the gradation voltages P1 to P4 to be output. Furthermore, the output control unit 124 supplies input switching signals SA, SB, SC, and SD that control the demultiplexer unit 200 included in the display panel 20*e* according to the division number setting signal DVN and the cell arrangement signal CAS to the display panel 20*e*. That is, the output control unit 124 generates the input switching signals SA to SD that cause the driving voltage signals G1 to G4 to be input in turn to the respective data lines D of four, which is as many as the division number "4," at a cycle of the division periods obtained by dividing one horizontal scanning period by the division number "4" for the respective driving voltage signals G1 to G4 corresponding to the respective gradation voltages P1 to P4 according to the division number setting signal DVN and the cell arrangement signal CAS. The output control unit 124 outputs the input switching signals SA to SD to the display panel 20*e*.

According to the output switching signals Sa to Sd, in each of the N-th (N is an integer of 1 to n) horizontal scanning period and the (N+1)-th horizontal scanning period, in each of the first to a fourth division periods obtained by dividing one horizontal scanning period by four, the multiplexer circuit MUX supplies the gradation voltages E1 to E4 in the mode illustrated in FIG. 18 to the amplifiers AP1 to AP4 as the respective gradation voltages P1 to P4.

The demultiplexer unit 200 included in the display panel 20*e* includes a demultiplexer circuit DMXb constituted of demultiplexers WS1 to WS4 respectively and individually receiving the driving voltage signals G1 to G4.

Each of the demultiplexers WS1 to WS4 includes a switch A controlled on and off by the input switching signal SA supplied from the data driver 12, a switch B controlled on and off by the input switching signal SB, a switch C controlled on and off by the input switching signal SC, and a switch D controlled on and off by the input switching signal SD.

The switch A of the demultiplexer WS1 supplies the driving voltage signal G1 to the data line D1 when it is set to ON state. The switch B of the demultiplexer WS1 supplies the driving voltage signal G1 to the data line D2 when it is set to ON state. The switch C of the demultiplexer WS1 supplies the driving voltage signal G1 to the data line D3 when it is set to ON state. The switch D of the demultiplexer WS1 supplies the driving voltage signal G1 to the data line D4 when it is set to ON state.

The switch D of the demultiplexer WS2 supplies the driving voltage signal G2 to the data line D5 when it is set to ON state. The switch A of the demultiplexer WS2 supplies the driving voltage signal G2 to the data line D6 when it is set to ON state. The switch B of the demultiplexer WS2 supplies the driving voltage signal G2 to the data line D7 when it is set to ON state. The switch C of the demultiplexer WS2 supplies the driving voltage signal G2 to the data line D8 when it is set to ON state.

The switch C of the demultiplexer WS3 supplies the driving voltage signal G3 to the data line D9 when it is set to ON state. The switch D of the demultiplexer WS3 supplies the driving voltage signal G3 to the data line D10 when it is set to ON state. The switch A of the demultiplexer WS3 supplies the driving voltage signal G3 to the data line D11 when it is set to ON state. The switch B of the demultiplexer WS3 supplies the driving voltage signal G3 to the data line D12 when it is set to ON state.

The switch B of the demultiplexer WS4 supplies the driving voltage signal G4 to the data line D13 when it is set to ON state. The switch C of the demultiplexer WS4 supplies the driving voltage signal G4 to the data line D14 when it is set to ON state. The switch D of the demultiplexer WS4 supplies the driving voltage signal G4 to the data line D15 when it is set to ON state. The switch A of the demultiplexer WS4 supplies the driving voltage signal G4 to the data line D16 when it is set to ON state.

The switches A to D included in the demultiplexers WS1 to WS4 are controlled on and off as illustrated in FIG. 18 according to the input switching signals SA to SD output from the output control unit 124.

That is, as illustrated in FIG. 18, the switches A in the respective demultiplexers WS1 to WS4 are set to ON state in the first division period in each of the N-th and the (N+1)-th horizontal scanning periods and set to OFF state in the other periods according to the input switching signal SA. The switches B in the respective demultiplexers WS1 to WS4 are set to ON state in the second division period in each of the N-th and the (N+1)-th horizontal scanning periods and set to OFF state in the other periods according to the input switching signal SB. The switches C in the respective demultiplexers WS1 to WS4 are set to ON state in the third division period in each of the N-th and the (N+1)-th horizontal scanning periods and set to OFF state in the other periods according to the input switching signal SC. The switches D in the respective demultiplexers WS1 to WS4 are set to ON state in the fourth division period in each of the N-th and the (N+1)-th horizontal scanning periods and set to OFF state in the other periods according to the input switching signal SD.

With the operations of the multiplexer circuit MUX and the demultiplexers WS1 to WS4 illustrated in FIG. 17, in the first division period in the (N)-th horizontal scanning period, the driving voltage signal G1 having the gradation voltage E1 according to the gamma correction characteristic of the red color component, the driving voltage signal G2 having the gradation voltage E2 according to the gamma correction characteristic of the green color component, the driving voltage signal G3 having the gradation voltage E3 according to the gamma correction characteristic of the blue color component, and the driving voltage signal G4 having the gradation voltage E4 according to the gamma correction characteristic of the green color component are respectively supplied to the red display cell Pr, the green display cell Pg, the blue display cell Pb, and the green display cell Pg on the (N)-th row via the respective data lines D1, D6, D11, and D16.

In the second division period in the (N)-th horizontal scanning period, the driving voltage signal G1 having the gradation voltage E2 according to the gamma correction characteristic of the green color component, the driving voltage signal G2 having the gradation voltage E3 according to the gamma correction characteristic of the blue color component, the driving voltage signal G3 having the gradation voltage E4 according to the gamma correction characteristic of the green color component, and the driving voltage signal G4 having the gradation voltage E1 according to the gamma correction characteristic of the red color component are respectively supplied to the green display cell Pg, the blue display cell Pb, the green display cell Pg, and the red display cell Pr on the (N)-th row via the respective data lines D2, D7, D12, and D13.

In the third division period in the (N)-th horizontal scanning period, the driving voltage signal G1 having the gradation voltage E3 according to the gamma correction characteristic of the blue color component, the driving voltage signal G2 having the gradation voltage E4 according to the gamma correction characteristic of the green color component, the driving voltage signal G3 having the gradation voltage E1 according to the gamma correction characteristic of the red color component, and the driving voltage signal G4 having the gradation voltage E2 according to the gamma correction characteristic of the green color component are respectively supplied to the blue display cell Pb, the green display cell Pg, the red display cell Pr, and the green display cell Pg on the (N)-th row via the respective data lines D3, D8, D9, and D14.

In the fourth division period in the (N)-th horizontal scanning period, the driving voltage signal G1 having the gradation voltage E4 according to the gamma correction characteristic of the green color component, the driving voltage signal G2 having the gradation voltage E1 according to the gamma correction characteristic of the red color component, the driving voltage signal G3 having the gradation voltage E2 according to the gamma correction characteristic of the green color component, and the driving voltage signal G4 having the gradation voltage E3 according to the gamma correction characteristic of the blue color component are respectively supplied to the green display cell Pg, the red display cell Pr, the green display cell Pg, and the blue display cell Pb on the (N)-th row via the respective data lines D4, D5, D10, and D15.

In the first division period in the (N+1)-th horizontal scanning period, the driving voltage signal G1 having the gradation voltage E3 according to the gamma correction characteristic of the blue color component, the driving voltage signal G2 having the gradation voltage E2 according to the gamma correction characteristic of the green color component, the driving voltage signal G3 having the gradation voltage E1 according to the gamma correction characteristic of the red color component, and the driving voltage signal G4 having the gradation voltage E4 according to the gamma correction characteristic of the green color component are respectively supplied to the blue display cell Pb, the green display cell Pg, the red display cell Pr, and the green display cell Pg on the (N+1)-th row via the respective data lines D1, D6, D1*l*, and D16.

In the second division period in the (N+1)-th horizontal scanning period, the driving voltage signal G1 having the gradation voltage E2 according to the gamma correction characteristic of the green color component, the driving voltage signal G2 having the gradation voltage E1 according to the gamma correction characteristic of the red color component, the driving voltage signal G3 having the gradation voltage E4 according to the gamma correction characteristic of the green color component, and the driving voltage signal G4 having the gradation voltage E3 according to the gamma correction characteristic of the blue color component are respectively supplied to the green display cell Pg, the red display cell Pr, the green display cell Pg, and the blue display cell Pb on the (N+1)-th row via the respective data lines D2, D7, D12, and D13.

In the third division period in the (N+1)-th horizontal scanning period, the driving voltage signal G1 having the gradation voltage E1 according to the gamma correction characteristic of the red color component, the driving voltage signal G2 having the gradation voltage E4 according to the gamma correction characteristic of the green color component, the driving voltage signal G3 having the gradation voltage E3 according to the gamma correction characteristic of the blue color component, and the driving voltage signal G4 having the gradation voltage E2 according to the gamma correction characteristic of the green color component are respectively supplied to the red display cell Pr, the green display cell Pg, the blue display cell Pb, and the green display cell Pg on the (N+1)-th row via the respective data lines D3, D8, D9, and D14.

In the fourth division period in the (N+1)-th horizontal scanning period, the driving voltage signal G1 having the gradation voltage E4 according to the gamma correction characteristic of the green color component, the driving voltage signal G2 having the gradation voltage E3 according to the gamma correction characteristic of the blue color component, the driving voltage signal G3 having the gradation voltage E2 according to the gamma correction characteristic of the green color component, and the driving voltage signal G4 having the gradation voltage E1 according to the gamma correction characteristic of the red color component are respectively supplied to the green display cell Pg, the blue display cell Pb, the green display cell Pg, and the red display cell Pr on the (N+1)-th row via the respective data lines D4, D5, D10, and D15.

Figure 19:
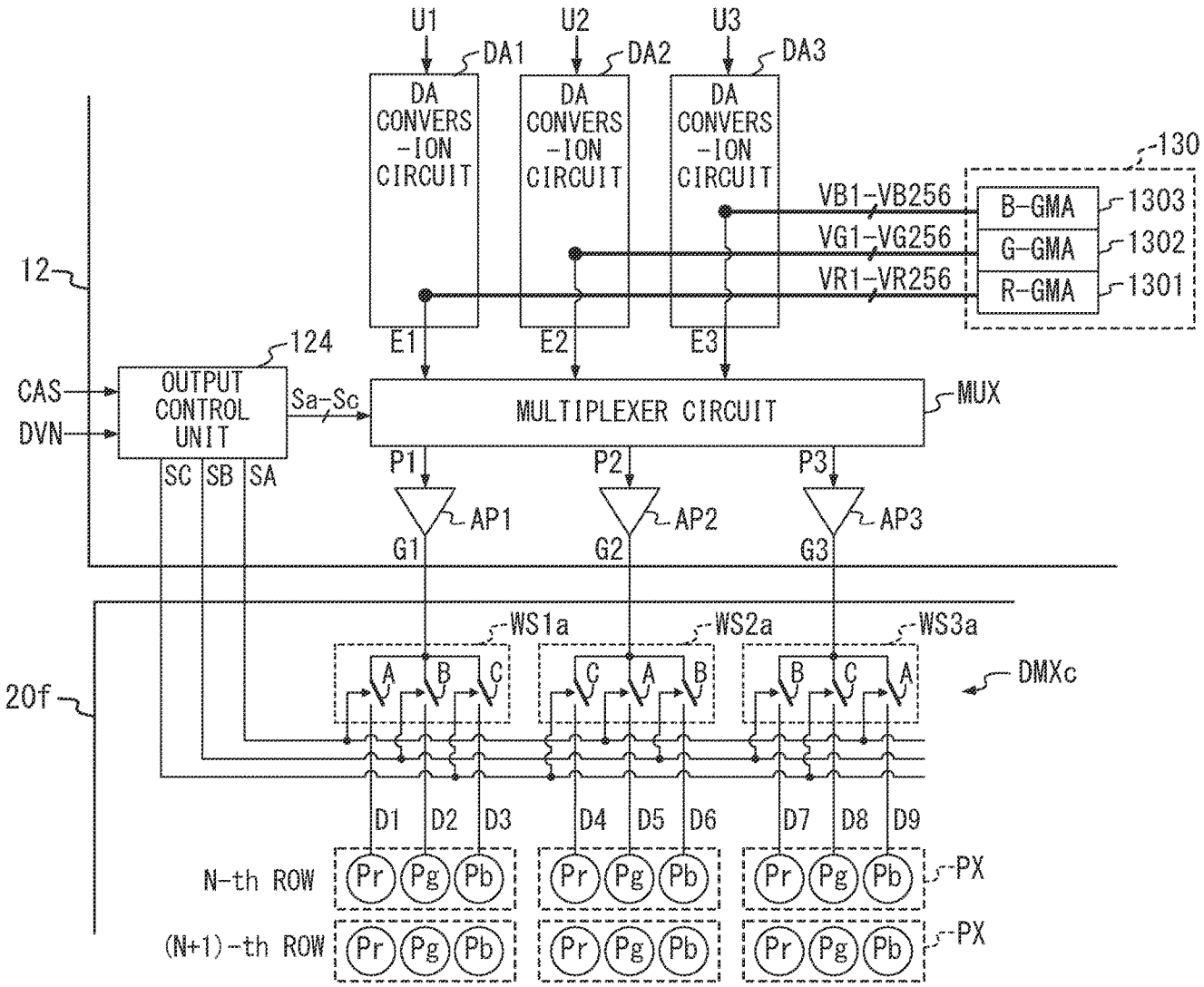
FIG. 19 is a lock diagram excerpting and illustrating circuit blocks involved in the driving voltage signals G1 to G3 from each of a display panel 20*f* that has the RGB stripe arrangement and is of a time-divisionally driven type with a division number "3" and the data driver 12.

FIG. 19 is a block diagram excerpting and illustrating circuit blocks involved in the driving voltage signals G1 to G3 from each of a display panel 20*f* that has the RGB stripe arrangement and of the time-divisionally driven type with the division number "3" and the data driver 12 that drives the display panel 20*f*. Similarly to FIG. 10, also in FIG. 19, for the convenience of the drawing, the DA conversion unit 122 and the output unit 123 are illustrated in a minimum group configuration, but the actual configuration is a configuration in which the minimum group configurations illustrated in FIG. 19 are extended to an integer multiple. The DA conversion circuits DA1 to DA3, the gradation reference voltage generating unit 130, and the amplifiers AP1 to AP3 illustrated in FIG. 19 are the same as those illustrated in FIG. 10, thus omitting the detailed description.

Since the display panel 20*f* has the RGB stripe arrangement and is of the time-divisionally driven type with the division number "3," the output control unit 124 illustrated in FIG. 19 receive the division number setting signal DVN indicating the division number "3" and the cell arrangement signal CAS indicating the RGB stripe arrangement. The output control unit 124 supplies the multiplexer circuit MUX with the output switching signals Sa, Sb, and Sc that cause the gradation voltages E1 to E3 to be assigned to the respective gradation voltages P1 to P3 in the mode illustrated in FIG. 20 according to the division number setting signal DVN and the cell arrangement signal CAS and the gradation voltages P1 to P3 to be output. Furthermore, the output control unit 124 supplies the input switching signals SA, SB, and SC that control the demultiplexer unit 200 included in the display panel 20*f* according to the division number setting signal DVN and the cell arrangement signal CAS to the display panel 20*f*. That is, the output control unit 124 generates the input switching signals SA to SC that cause the driving voltage signals G1 to G3 to be input in turn to the respective data lines D of three, which is as many as the division number "3," at a cycle of the division periods obtained by dividing one horizontal scanning period by the division number "3" for the respective driving voltage signals G1 to G3 corresponding to the respective gradation voltages P1 to P3 according to the division number setting signal DVN and the cell arrangement signal CAS. The output control unit 124 outputs the input switching signals SA to SC to the display panel 20*f*.

According to the output switching signals Sa to Sc, in each of the N-th (N is an integer of 1 to n) horizontal scanning period and the (N+1)-th horizontal scanning period, in each of the first to the third division periods obtained by dividing one horizontal scanning period by three, the multiplexer circuit MUX assigns the gradation voltages E1 to E3 to the respective gradation voltages P1 to P3 in the mode illustrated in FIG. 20, and supplies the gradation voltages P1 to P3 to the amplifiers AP1 to AP3.

The demultiplexer unit 200 included in the display panel 20*f* includes a demultiplexer circuit DMXc constituted of demultiplexers WS1*a*, WS2*a*, and WS3*a* respectively and individually receiving the driving voltage signals G1 to G3.

Each of the demultiplexers WS1*a* to WS3*a* includes a switch A controlled on and off by the input switching signal SA supplied from the data driver 12, a switch B controlled on and off by the input switching signal SB, and a switch C controlled on and off by the input switching signal SC.

The switch A of the demultiplexer WS1*a* supplies the driving voltage signal G1 to the data line D1 when it is set to ON state. The switch B of the demultiplexer WS1*a* supplies the driving voltage signal G1 to the data line D2 when it is set to ON state. The switch C of the demultiplexer WS1*a* supplies the driving voltage signal G1 to the data line D3 when it is set to ON state.

The switch C of the demultiplexer WS2*a* supplies the driving voltage signal G2 to the data line D4 when it is set to ON state. The switch A of the demultiplexer WS2*a* supplies the driving voltage signal G2 to the data line D5 when it is set to ON state. The switch B of the demultiplexer WS2*a* supplies the driving voltage signal G2 to the data line D6 when it is set to ON state.

The switch B of the demultiplexer WS3*a* supplies the driving voltage signal G3 to the data line D7 when it is set to ON state. The switch C of the demultiplexer WS3*a* supplies the driving voltage signal G3 to the data line D8 when it is set to ON state. The switch A of the demultiplexer WS3*a* supplies the driving voltage signal G3 to the data line D9 when it is set to ON state.

The switches A to C included in the demultiplexers WS1*a* to WS3*a* are controlled on and off as illustrated in FIG. 20 according to the input switching signals SA to SC output from the output control unit 124.

That is, as illustrated in FIG. 20, the switches A in the respective demultiplexers WS1*a* to WS3*a* are set to ON state in the first division period in each of the N-th and the (N+1)-th horizontal scanning periods and set to OFF state in the other periods according to the input switching signal SA. The switches B in the respective demultiplexers WS1*a* to WS3*a* are set to ON state in the second division period in each of the N-th and the (N+1)-th horizontal scanning periods and set to OFF state in the other periods according to the input switching signal SB. The switches C in the respective demultiplexers WS1*a* to WS3*a* are set to ON state in the third division period in each of the N-th and the (N+1)-th horizontal scanning periods and set to OFF state in the other periods according to the input switching signal SC.

Accordingly, with the operations of the multiplexer circuit MUX and the demultiplexer circuit DMXc including the demultiplexers WS1*a* to WS3*a* illustrated in FIG. 19, in the first division period in the (N)-th horizontal scanning period, the driving voltage signal G1 having the gradation voltage E1 according to the gamma correction characteristic of the red color component, the driving voltage signal G2 having the gradation voltage E2 according to the gamma correction characteristic of the green color component, and the driving voltage signal G3 having the gradation voltage E3 according to the gamma correction characteristic of the blue color component are respectively supplied to the red display cell Pr, the green display cell Pg, and the blue display cell Pb on the (N)-th row via the respective data lines D1, D5, and D9.

In the second division period in the (N)-th horizontal scanning period, the driving voltage signal G1 having the gradation voltage E2 according to the gamma correction characteristic of the green color component, the driving voltage signal G2 having the gradation voltage E1 according to the gamma correction characteristic of the red color component, and the driving voltage signal G3 having the gradation voltage E3 according to the gamma correction characteristic of the blue color component are respectively supplied to the green display cell Pg, the red display cell Pr, and the blue display cell Pb on the (N)-th row via the respective data lines D2, D6, and D7.

In the third division period in the (N)-th horizontal scanning period, the driving voltage signal G1 having the gradation voltage E3 according to the gamma correction characteristic of the blue color component, the driving voltage signal G2 having the gradation voltage E1 according to the gamma correction characteristic of the red color component, and the driving voltage signal G3 having the gradation voltage E2 according to the gamma correction characteristic of the green color component are respectively supplied to the blue display cell Pb, the red display cell Pr, and the green display cell Pg on the (N)-th row via the respective data lines D3, D4 and D8.

In the first division period in the (N+1)-th horizontal scanning period, the driving voltage signal G1 having the gradation voltage E1 according to the gamma correction characteristic of the red color component, the driving voltage signal G2 having the gradation voltage E2 according to the gamma correction characteristic of the green color component, and the driving voltage signal G3 having the gradation voltage E3 according to the gamma correction characteristic of the blue color component are respectively supplied to the red display cell Pr, the green display cell Pg, and the blue display cell Pb on the (N+1)-th row via the respective data lines D1, D5, and D9.

In the second division period in the (N+1)-th horizontal scanning period, the driving voltage signal G1 having the gradation voltage E2 according to the gamma correction characteristic of the green color component, the driving voltage signal G2 having the gradation voltage E1 according to the gamma correction characteristic of the red color component, and the driving voltage signal G3 having the gradation voltage E3 according to the gamma correction characteristic of the blue color component are respectively supplied to the green display cell Pg, the red display cell Pr, and the blue display cell Pb on the (N+1)-th row via the respective data lines D2, D6, and D7.

In the third division period in the (N+1)-th horizontal scanning period, the driving voltage signal G1 having the gradation voltage E3 according to the gamma correction characteristic of the blue color component, the driving voltage signal G2 having the gradation voltage E1 according to the gamma correction characteristic of the red color component, and the driving voltage signal G3 having the gradation voltage E2 according to the gamma correction characteristic of the green color component are respectively supplied to the blue display cell Pb, the red display cell Pr, and the green display cell Pg on the (N+1)-th row via the respective data lines D3, D4, and D8.

While in the above-described embodiments, the display panel in which each cell group is configured of four display cells (Pr, Pg, Pb, and Pg) is employed as the display panels 20*a* and 20*b* having the PenTile matrix as the driving object of the data driver 12, a display panel in which each cell group is configured of a plurality of display cells of five or more may be employed. For display colors of the respective display cells, a display cell in a color other than red, green, or blue may be employed. For example, a display cell in white in addition to the display cells in red, green, and blue may be employed. This leads to additionally dispose a gradation reference voltage generating circuit according to a gamma correction characteristic for the color other than red, green, or blue. For example, when a cell group including a display cell functioning for a white color as the color other than red, green, or blue is employed as each cell group, a white gamma gradation reference voltage generating circuit that generates a gradation reference voltage group according to the gamma correction characteristic of a white color component is additionally disposed. A configuration in which a quarter of DA conversion circuits among the first to y-th DA conversion circuits are coupled to the white gamma gradation reference voltage generating circuit or the green gamma gradation reference voltage generating circuit 1302 is employed.

In short, the data driver 12 sets the display panel (20*a* to 200 that has the stripe arrangement or the PenTile matrix and is of the time-divisionally driven type or the normally driven type as a driving object. In the display panel, the plurality of display cells (PX) that configure cell groups each including j (j is an integer of two or more) display cells arranged side by side on each of the plurality of horizontal scanning lines (S1 to Sn). The plurality of horizontal scanning lines (S1 to Sn) are arranged side by side and intersects with the plurality of data lines (D1 to Dm). As the data driver 12, it is only necessary that it includes the following first to j-th DA conversion circuits, output unit, and output control unit together with the plurality of gradation reference voltage generating circuits (1301 to 1303) that steadily generate the gradation reference voltage groups (for example, VR1 to VR256, VG1 to VG256, or VB1 to VB256) each of which complies with the gamma correction characteristics of the color components different from one another.

That is, the first to j-th DA conversion circuits (for example, DA1 to DA4) are configured by being disposed corresponding to the above-described cell groups and including the respective different color components, and are each fixedly coupled to one of the above-described plurality of gradation reference voltage generating circuits. Each of the first to j-th DA conversion circuits selects the gradation reference voltage corresponding to the luminance level represented by the pixel data piece among the gradation reference voltage group generated in the one gradation reference voltage generating circuit and outputs this as the gradation voltage.

The output units (for example, 123, MUX, and AP1 to AP4) receive the above-described first to j-th gradation voltages together with the output switching signals (for example, Sa and Sb), assign the first to j-th gradation voltages (for example, E1 to E4) to the respective first to j-th driving voltage signals (for example, G1 to G4) in the mode according to these output switching signals, and output the assigned first to j-th driving voltage signals to the display panel.

The output control unit (124) receives the division number setting signal (DVN) indicating the division number, and generates the signals to switch the modes of assigning the first to j-th gradation voltages to the first to j-th driving voltage signals at every division period obtained by dividing the horizontal scanning period by the division number as the output switching signals (for example, Sa and Sb). Furthermore, the output control unit (124) generates and outputs the input switching signals (for example, SA and SB) that cause the driving voltage signals to be input in turn to the respective data lines as many as the division number at a cycle of the division periods for the respective first to j-th driving voltage signals.

With such a configuration, even though any one of the display panels that has the PenTile matrix or the stripe arrangement and is of the time-divisionally driven type, the normally driven type, or the like is the driving object, switching of the gamma characteristics for the reference gradation voltage groups is not necessary when the DA conversion that converts the pixel data piece to the analog gradation voltage using the reference gradation voltage group. With this, a delay in association with the switching process of the gamma characteristics is not generated, thereby ensuring the high-speed driving of the display panel.

Furthermore, the display driver according to the present invention can drive the various kinds of display panels that have the PenTile matrix or the stripe arrangement and are of the time-divisionally driven type, the normally driven type, or the like, thereby ensuring the reduced manufacturing cost.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims.

What is claimed is:

1. A display driver that drives a display panel in which a plurality of display cells constituting cell groups each including j (j is an integer of two or more) display cells are arranged side by side on each of a plurality of horizontal scanning lines, the plurality of horizontal scanning lines being arranged side by side and intersecting with a plurality of data lines, the display driver driving the display panel according to pixel data pieces corresponding respectively to the plurality of display cells, the display driver comprising:

a plurality of gradation reference voltage generating circuits that steadily generate respective gradation reference voltage groups according to gamma correction characteristics of color components different from one another;

first to j-th digital to analog conversion circuits that select a gradation reference voltage corresponding to a luminance level represented by a pixel data piece among a gradation reference voltage group to output the gradation reference voltage as a gradation voltage, the first to j-th digital to analog conversion circuits being disposed corresponding to the cell groups, the first to j-th digital to analog conversion circuits being configured by including respective different color components, the first to j-th digital to analog conversion circuits being each fixedly coupled to one of the plurality of gradation reference voltage generating circuits, the gradation reference voltage group being generated by the one of the gradation reference voltage generating circuits;

an output unit that receives the first to j-th gradation voltages together with an output switching signal, the output unit assigning the first to j-th gradation voltages to respective first to j-th driving voltage signals in a mode according to the output switching signal, the output unit outputting the assigned first to j-th driving voltage signals to the display panel; and an output control unit that receives a division number setting signal indicating a division number to generate a signal to switch modes of assigning the first to j-th gradation voltages to the first to j-th driving voltage signals at every division period obtained by dividing a horizontal scanning period by the division number as the output switching signal, the output control unit generating and outputting an input switching signal that causes the first to j-th driving voltage signals to be input in turn to respective data lines as many as the division number at a cycle of division periods for the respective first to j-th driving voltage signals.

2. The display driver according to claim 1, wherein the output unit includes:

a multiplexer circuit that receives the first to j-th gradation voltages together with the output switching signal, the multiplexer circuit assigning the first to j-th gradation voltages to first to j-th voltages in a mode according to the output switching signal, the multiplexer circuit outputting the first to j-th voltages; and first to j-th amplifiers that output voltages obtained by respectively and individually amplifying the first to j-th voltages to the display panel as the first to j-th driving voltage signals.

3. The display driver according to claim 1, wherein the output unit includes:

first to j-th amplifiers that output voltages obtained by respectively amplifying the first to j-th gradation voltages as first to j-th voltages; and a multiplexer circuit that receives the first to j-th voltages together with the output switching signal, the multiplexer circuit assigning the first to j-th voltages to the first to j-th driving voltage signals in a mode according to the output switching signal, the multiplexer circuit outputting the first to j-th driving voltage signals to the display panel.

4. The display driver according to claim 1, wherein the output control unit stops generating the input switching signal when the division number indicated by the division number setting signal is one.

5. The display driver according to claim 1, wherein the plurality of gradation reference voltage generating circuits include:

a red gamma gradation reference voltage generating circuit that generates a gradation reference voltage group according to a gamma correction characteristic of a red color component;

a green gamma gradation reference voltage generating circuit that generates a gradation reference voltage group according to a gamma correction characteristic of a green color component; and a blue gamma gradation reference voltage generating circuit that generates a gradation reference voltage group according to a gamma correction characteristic of a blue color component.

6. The display driver according to claim 5, wherein the j is a multiple of three, and a third of the first to j-th digital to analog conversion circuits are coupled to the red gamma gradation reference voltage generating circuit, a third of the first to j-th digital to analog conversion circuits are coupled to the green gamma gradation reference voltage generating circuit, and a third of the first to j-th digital to analog conversion circuits are coupled to the blue gamma gradation reference voltage generating circuit.

7. A display apparatus comprising:

a display panel in which a plurality of display cells constituting cell groups each including j (j is an integer of two or more) display cells are arranged side by side on each of a plurality of horizontal scanning lines, the plurality of horizontal scanning lines being arranged side by side and intersecting with a plurality of data lines; and a display driver that drives the display panel according to pixel data pieces corresponding respectively to the plurality of display cells, wherein the display driver includes:

a plurality of gradation reference voltage generating circuits that steadily generate respective gradation reference voltage groups according to gamma correction characteristics of color components different from one another;

first to j-th digital to analog conversion circuits that select a gradation reference voltage corresponding to a luminance level represented by a pixel data piece among a gradation reference voltage group to output the gradation reference voltage as a gradation voltage, the first to j-th digital to analog conversion circuits being disposed corresponding to the cell groups, the first to j-th digital to analog conversion circuits being configured by including respective different color components, the first to j-th digital to analog conversion circuits being each fixedly coupled to one of the plurality of gradation reference voltage generating circuits, the gradation reference voltage group being generated by the one of the gradation reference voltage generating circuits;

an output unit that receives the first to j-th gradation voltages together with an output switching signal, the output unit assigning the first to j-th gradation voltages to respective first to j-th driving voltage signals in a mode according to the output switching signal, the output unit outputting the assigned first to j-th driving voltage signals to the display panel; and an output control unit that receives a division number setting signal indicating a division number to generate a signal to switch modes of assigning the first to j-th gradation voltages to the first to j-th driving voltage signals at every division period obtained by dividing a horizontal scanning period by the division number as the output switching signal, the output control unit generating an input switching signal that causes the first to j-th driving voltage signals to be input in turn to the respective data lines as many as the division number at a cycle of division periods for respective first to j-th driving voltage signals, the output control unit outputting the input switching signal to the display panel.

8. The display apparatus according to claim 7, wherein the display panel is of a normally driven type or a time-divisionally driven type, the normally driven type supplying the first to j-th driving voltage signals output from the output unit to the respective data lines, the time-divisionally driven type including a demultiplexer that causes the first to j-th driving voltage signals to be input in turn to the respective data lines as many as the division number for the respective first to j-th driving voltage signals according to the input switching signal output from the output unit.

9. The display apparatus according to claim 8, wherein the respective data lines as many as the division number are adjacently arranged side by side on the display panel.

10. The display apparatus according to claim 7, wherein the display panel has a PenTile matrix or a stripe arrangement, the PenTile matrix configuring a color pixel with a red display cell, a green display cell, a blue display cell, and a green display cell of four adjacent to one another as one unit, the stripe arrangement configuring a color pixel with display cells of at least three different color components including a red display cell, a green display cell, and a blue display cell adjacently arranged side by side as one unit.

* * * * *